US006312093B1

(12) United States Patent
Saijo et al.

(10) Patent No.: US 6,312,093 B1
(45) **Date of Patent: *Nov. 6, 2001**

(54) INK JET RECORDING APPARATUS

(75) Inventors: Yasutsugu Saijo, Tokyo; Takahiro Sakamoto, Yokohama, both of (JP)

(73) Assignee: Canon Kabushiki Kaisha, Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/190,095

(22) Filed: Nov. 12, 1998

(30) Foreign Application Priority Data

Nov. 14, 1997 (JP) ..... 9-313853
Nov. 14, 1997 (JP) ..... 9-331148

(51) Int. Cl.[7] ..... B41J 2/165
(52) U.S. Cl. ..... 347/30; 347/23; 347/33
(58) Field of Search ..... 347/30, 29, 33, 347/32, 22

(56) References Cited

U.S. PATENT DOCUMENTS 5,733,055 3/1998 Hiramatsu et al. ..... 400/355
5,831,644 * 11/1998 Kato ..... 347/22
5,831,646 * 11/1998 Kuronuma et al. ..... 347/30
5,975,676 11/1999 Saijo ..... 347/22
6,015,202 1/2000 Hirawatsu et al. ..... 347/32

FOREIGN PATENT DOCUMENTS 0 540 344 5/1993 (EP) .
0 676 291 10/1995 (EP) .
0 785 084 1/1997 (EP) .
7-017061 1/1995 (JP) .
8-118611 5/1996 (JP) .
8-224895 9/1996 (JP) .
9-109380 4/1997 (JP) .
9-169121 6/1997 (JP) .

* cited by examiner

*Primary Examiner*—N. Le
*Assistant Examiner*—Shih-Wen Hsieh
(74) *Attorney, Agent, or Firm*—Fitzpatrick, Cella, Harper & Scinto

(57) ABSTRACT

In an ink jet recording apparatus provided with a recording head having a discharge port for discharging ink, sucking device for effecting suction from the discharge port, a wiping for wiping a surface in which the discharge port is disposed, and a plurality of paper supply devices for conveying recording mediums on which recording is to be effected by the recording head, the wiping operation of the wiper, the sucking operation of the sucking device, and the selection and driving of the plurality of paper supply device are done by a common drive source.

8 Claims, 23 Drawing Sheets

INK JET RECORDING APPARATUS

BACKGROUND OF THE INVENTION

1. Field of the Invention

This invention relates to an ink jet recording apparatus for discharging ink from recording means to a recording medium to thereby effect recording.

2. Related Background Art

A recording apparatus having the function of a printer, a copying apparatus, a facsimile apparatus or the like or a recording apparatus used as the output instrument of a compound type electronic apparatus including a computer or a word processor, or a work station or the like is designed to record images (including characters, symbols, etc.) on a recording medium such as paper, cloth, a plastic sheet or an OHP sheet (hereinafter simply referred to as the recording paper) on the basis of recording information. This recording apparatus can be classified into an ink jet type, a wire dot type, a thermal type, a laser beam type, etc. depending on the recording system.

In a recording apparatus of the serial type for effecting recording while main-scanning in a direction intersecting with the conveyance direction (paper feed direction or sub-scanning direction) of a recording medium, the operation of recording (main-scanning) an image by recording means (a recording head) moved along the recording medium, effecting a predetermined amount of paper feeding (pitch conveyance as sub-scanning) after having completed a line of recording, and thereafter effecting the recording (main-scanning) of the image of the next line on the recording medium stopped again is repeated, whereby recording is effected within a desired range of the recording medium. On the other hand, in a recording apparatus of the line type for effecting recording by only sub-scanning in the conveyance direction of a recording medium, the recording medium is set at a predetermined recording position, and a predetermined amount of paper feeding (pitch feeding) is effected while the recording of a line is continuously effected in the lump, whereby an image is recorded within a desired range of the recording medium.

A recording apparatus of the ink jet type (an ink jet recording apparatus) discharges ink from recording means (a recording head) to a recording medium to thereby effect recording, and has the advantages that the recording means is easy to make compact, highly fine images can be recorded at a high speed, recording can be done without any special treatment being required of plain paper, the running cost is low and noise is little because of the non-impact type and moreover, it is easy to use many kinds of inks (e.g. colored inks) to record color images.

The above-described ink jet recording apparatus is generally provided with driving means (in the case of the serial type) for driving a carriage carrying the recording head thereon, conveying means for conveying the recording medium (recording paper), and control means for controlling the driving means and the conveying means. On the other hand, energy generating elements for generating energy utilized to discharge ink from the discharge port of the recording head include one using an electro-thermal converting member such as a piezoelectric element, one for applying an electromagnetic wave such as a laser to thereby generate heat, and discharging ink droplets by this heat generating action, or one for heating liquid by an electro-thermal converting member having a heat generating resistance member.

Among them, recording means (a recording head) of the ink jet type utilizing heat energy to discharge ink as droplets can have its discharge ports arranged highly densely and can therefore effect recording of high resolution. Particularly, a recording head using an electro-thermal conversion element as an energy generating element is easy to make compact and can fully make the most of the merits of IC technology and micro-working technology of which the advance and improvement in the reliability in the recent field of semiconductor are remarkable and is advantageous since it is easy to mount it highly densely and the manufacturing cost thereof is low.

Also, there are various requirements for the material of the recording medium, and in recent years, the development for these requirement is advanced and recording apparatuses using, besides paper (including thin paper and worked paper) which are ordinary recording mediums and resin ordinary sheets (such as OHP), cloth, leather, unwoven fabric and further metals as the recording medium have come to be used.

One of the problems peculiar to the ink jet recording apparatus is the jamming of the discharge ports, and as means for solving this problem, use is generally made of jam recovering means having pump means as intermediary means. Specifically, there is carried out the process of sucking ink from a discharge port (the tip end of a nozzle) by a suction pump to thereby suck and discharge air bubbles in ink of high viscosity in a flow path for supplying ink into a recording head and system or minute dust or air bubbles in ink liquid as waste ink from the discharge port.

To realize jam recovering means, it is necessary to perform the opening and closing operation for a suction cap and the operation of the suction pump. As the means for that, a recovery system designed to change over the forward and reverse rotation of a one-way clutch and a motor and perform two operations arbitrarily is considered to be suitable, but such a recovery system suffers from problems to be solved. One of the problem is that when a transmission mechanism only in one direction (a one-way mechanism) is used for the driving of a cam, drive is not transmitted when a force with which a driven object tries to move faster than a driving speed works, and the driven object moves faster than the drive source (overruns) and the driven object is not stopped although the drive source is stopped on the way. That is, there is the problem that a right result is not obtained.

So, when the one-way transmission method is used, in order not to cause a cam to overrun, it is necessary to make the shape of the cam in a portion in which a cam follower lowers vertical so that the cam follower may not generate a force for causing the cam to overrun, and in that case, it is impossible to effect the control of stopping the cam on the way on which the cam follower is lowered. Also, there is the problem that great shock noise is created when the cam follower falls suddenly.

Also, overrunning can be solved by applying a sliding brake for suppressing rotation to the cam, but in that case, the load of the drive source increases. If an ordinary gear transmission mechanism is used to drive by a drive source having a holding property such as a stepping motor, it never happens that the cam overruns, but since the driving force is always coupled, there is the problem that different control cannot be effected between forward rotation and reverse rotation.

On the other hand, turning an eye to the driving system for the paper supply mechanism, it is seen that there is a further technical task. As an example of the ink jet recording apparatus according to the prior art, description will now be made of an ink jet recording apparatus having ASF (auto sheet feeder) paper supply as first paper supply means and sheet cassette paper supply as second paper supply means.

FIG. 26 of the accompanying drawings typically shows a driving system for the first and second paper feed means and recovery means of an ink jet recording apparatus according to the prior art.

In FIG. 26, the reference numerals 150 and 154 designate gears coupled to a drive source, not shown, and the reference characters 151*a* and 151*b* denote pendulum gears, and the gear 151*b* is rotated counter-clockwisely about the gear 151*a* when the gear 150 is rotated counter-clockwisely and, is connected to a gear 152*a*. The paper supply roller of first paper supply means, not shown, is connected to a gear 152*b*, and the rotation of the drive source is transmitted to the paper supply roller of the first paper supply means.

That is, the drive source connected to the gear 150 is rotated counter-clockwisely, whereby the paper supply roller of the first paper supply means can be rotated.

Next, when the drive source connected to the gear 150 is rotated clockwisely, the gear 151*b* is rotated clockwisely about the gear 151*a* and becomes connected to a gear 153*a*. The paper supply roller of second paper supply means, not shown, is connected to a gear 153*b*, and the rotation of the drive source is transmitted to the paper supply roller of the second paper supply means.

That is, by the drive source connected to the gear 150 being rotated clockwisely, the paper supply roller of the second paper supply means can be rotated.

On the other hand, when a drive source connected to a gear 154 is rotated clockwisely, a gear 155*b* is rotated clockwisely about a gear 155*a* and becomes connected to a gear 156*a*. By the rotation of a gear 156*b*, the sucking operation of a recovery system, not shown, is performed.

Next, when the drive source connected to the gear 154 is rotated counter-clockwisely the gear 155*b* is rotated counter-clockwisely about the gear 155*a* and becomes connected to a gear 157*a*. By the rotation of a gear 157*b*, the operation of the wiper piece of the recovery system, not shown, is performed.

In the above-described example of the prior art, however, it has been necessary to provide two drive sources to perform the recovering operations of two modes and the operation of the two paper supply means, and this has been against the space saving in the apparatus and has led to the problem of increased costs.

SUMMARY OF THE INVENTION

It is an object of the present invention to provide an ink jet recording apparatus which can perform recovering operations of a plurality of modes and the operations of a plurality of paper supply means by a common drive source.

It is another object of the present invention to provide a recovery system in an ink jet recording apparatus which can reliably prevent the overrun of a cam and also improve the stability of operation and which can secure sufficient stability even if the operation of the cam fluctuates minutely.

It is still another object of the present invention to provide an ink jet recording apparatus designed such that sucking means for effecting suction recovery is driven by the driving of a motor in one direction and capping means for contacting a cap with and spacing it apart from the discharge port surface of recording means by the driving of the motor in the opposite direction or both of this capping means and wiping means for wiping the discharge port surface are stably driven by a cam having a position detecting flag portion on the same shaft and cam phase detecting means.

According to such present invention, the recovering operation and the driving of a plurality of paper supply means are performed by a common drive source and therefore, a complicated mechanism can be provided inexpensively. That is, the amount of reverse rotation of the drive source is divided into first paper supply means, second paper supply means and the recovering operation, whereby the driving of a highly functioning recovery system of which the forward/reverse rotation is necessary and the driving of a plurality of paper supply means can be made single and thus, It becomes possible to achieve a reduction in cost.

Also, there is provided a recovery system in an ink jet recording apparatus which adopts a construction in which for the positioning of a cam in the case of a first recovery mode of two recovery modes, use is made of the first edge of a flag for detecting the position of the cam lying upstream of the cam used in the first recovery mode on a cam graph with respect to the direction of rotation thereof, and for the positioning of the cam in the case of a second recovery mode, use is made of a second edge of a position detecting flag lying downstream of the first edge on the cam graph with respect to the direction of rotation of the cam and upstream of a cam used in the second recovery mode with respect to the direction of rotation thereof, whereby during the positioning of the cam to a predetermined angle in each recovery mode, the positioning of the cam becomes possible at the smallest angle of rotation of the cam after the detection of the edge and therefore, quick and stable positioning of the cam becomes possible and improvements in the efficiency and reliability of the recovering operation can be achieved.

Also, by adopting a construction in which a first recovery mode is wiping and a second recovery mode is suction recovery or a construction in which the first recovery mode is for suction-recovering only a recording means and the second recovery mode is for suction-recovering or capping a plurality of recording means, whereby there is obtained the effect that the positioning of the cam can be efficiently effected in conformity with the respective recovery modes.

Also, there is provided a recovery system in an ink jet recording apparatus which adopts a construction in which a cam stopped in a first detection mode is rotated and a second detection mode is passed, whereafter when the cam is to be again positioned at a predetermined position in the first detection mode, a second edge of a cam flag lying upstream of a second detection mode area which is a trigger for the second detection mode with respect to the direction of rotation of the cam, whereafter the cam is rotated for a predetermined pulse or a predetermined time, whereafter the detecting operation for a first edge of a cam flag lying upstream of a first detection mode area of the cam with respect to the direction of rotation of the cam is made effective, and by the utilization of the detection of the first edge, the cam is positioned at a predetermined position in the first detection mode, whereby even if the minute drift of the cam occurs after the cam has passed the second detection edge, the second detection edge is not erroneously detected as the first detection edge and the cam can be positioned at a predetermined position in the regular first detection mode, and an improvement in the reliability of the recovering operation can be achieved.

Also, there is provided a recovery system in an ink jet recording apparatus which adopts a construction in which there are a plurality of capping modes in one detection mode of a cam and when from at least a capping state, a carriage carrying recording means thereon is to be moved, when there is present another capping mode downstream of the cam in said detection mode with respect to the direction of rotation thereof, the cam is first rotated to thereby minutely open a cap to a level for leaking air, whereafter suction means is operated to discharge ink in the cap and thereafter, the cam is further rotated to pass through another capping state, and the detection edge of a cam flag lying downstream of the cam with respect to the direction of rotation thereof is detected, whereafter the cam is rotated by a predetermined pulse and the cam is positioned at a position to which the carriage is movable, whereby the cap full of sucked ink can be prevented from again contacting with a discharge port surface during the rotating operation of the cam, and the mixing of inks in the recording means by the sucking operation and the scattering of the ink by the wiping of the discharge port surface after the sucking operation can be minimized and thus, an improvement in the reliability of the recovering operation can be achieved.

Also, there is provided a recovery system in an ink jet recording apparatus which adopts a construction in which an untoothed portion partly free of a gear is made in sucking means and when a gear for transmitting drive comes into that portion, the transmission of the drive to the suction means may be cut off, and an engagement member for returning from this drive transmission cut-off state to a transmittable state is driven by the cam and a portion of the engagement member bears against the suction means and renders the suction means drivable, whereby the positioning and redriving of the sucking means become possible by a simple construction and sequence and thus, an improvement in the reliability of the recovering operation can be achieved.

Also, there is provided a recovery system in an ink jet recording apparatus which adopts a construction in which the contact driving area of the engagement member of a cam with suction means overlaps the driving area for wiping means on a cam graph, whereby the cam area can be used more effectively, and the compactness and improved reliability of a recovery unit can be achieved. Also, by adopting a construction in which the drive transmission to sucking means and the drive transmission of a cam are effected by a one-way drive transmitting method in which drive is transmitted only in one of the forward and reverse driving directions of a motor, it becomes possible to achieve the above-described effect more efficiently.

Also, by adopting a construction in which a one-way drive transmitting method uses a pendulum gear transmission mechanism by a planetary gear, it becomes possible to achieve the above-described effect more efficiently. Also, by adopting a construction in which suction means is a tube pump, it becomes possible to achieve the above-described effect more efficiently.

DESCRIPTION OF THE PREFERRED EMBODIMENTS

Figure 1:
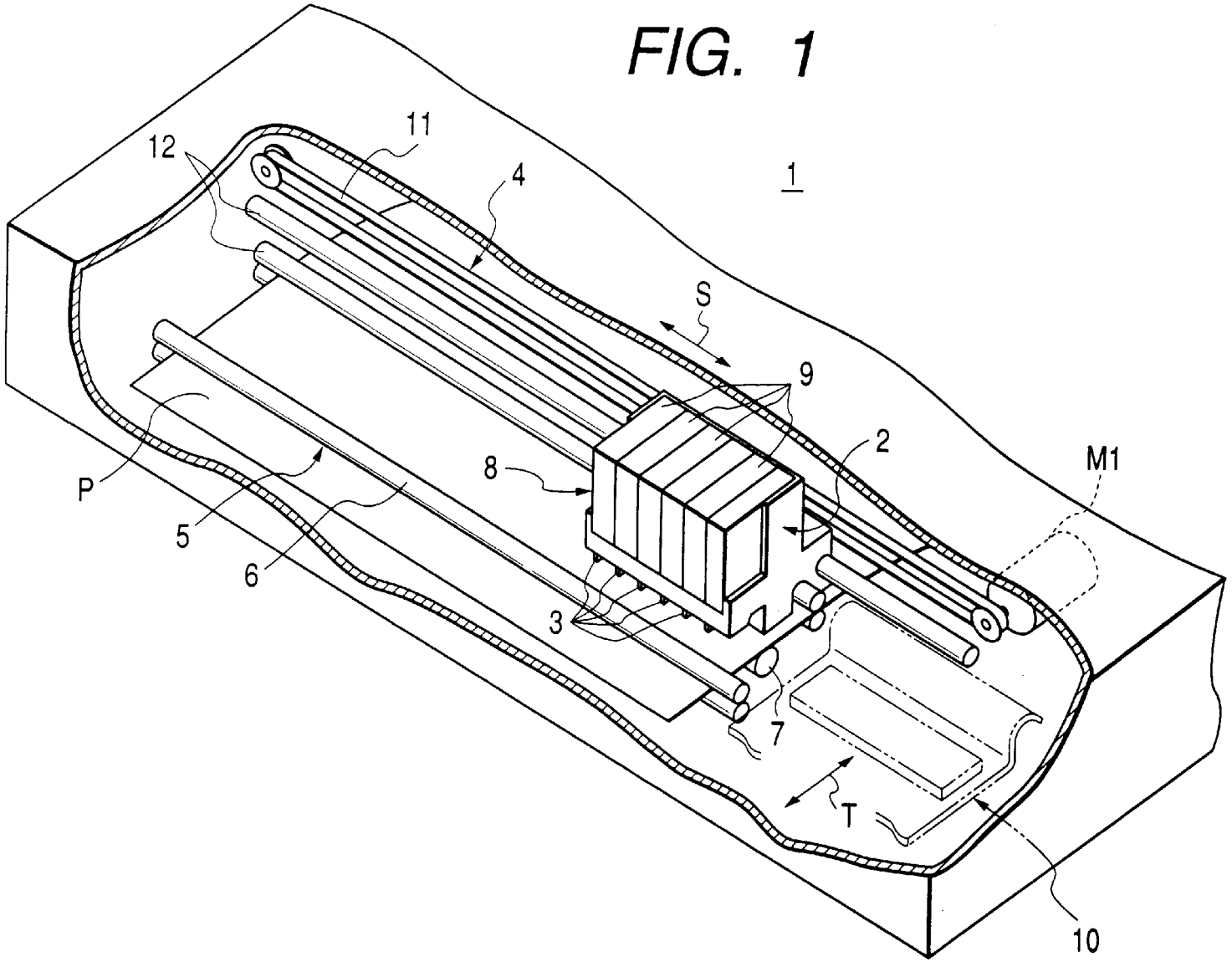
FIG. 1 is a partly broken-away typical perspective view showing an ink jet recording apparatus provided with a recovery system according to the present invention.

Some embodiments of the present invention will hereinafter be described with reference to the drawings. Throughout the drawings, the same reference numerals designate the same or corresponding portions. FIG. 1 is a partly broken-away typical perspective view showing an ink jet recording apparatus provided with a recovery system according to the present invention, FIG. 2 is a typical perspective view showing the cleaning device of the ink jet recording apparatus of FIG. 1 as it is seen from above it, and FIG. 3 is a typical side view showing the state before the start of the cleaning operation of the cleaning device in the recovery system of the ink jet recording apparatus according to the present invention (the ink jet recording apparatus of FIG. 1).

Figure 2:
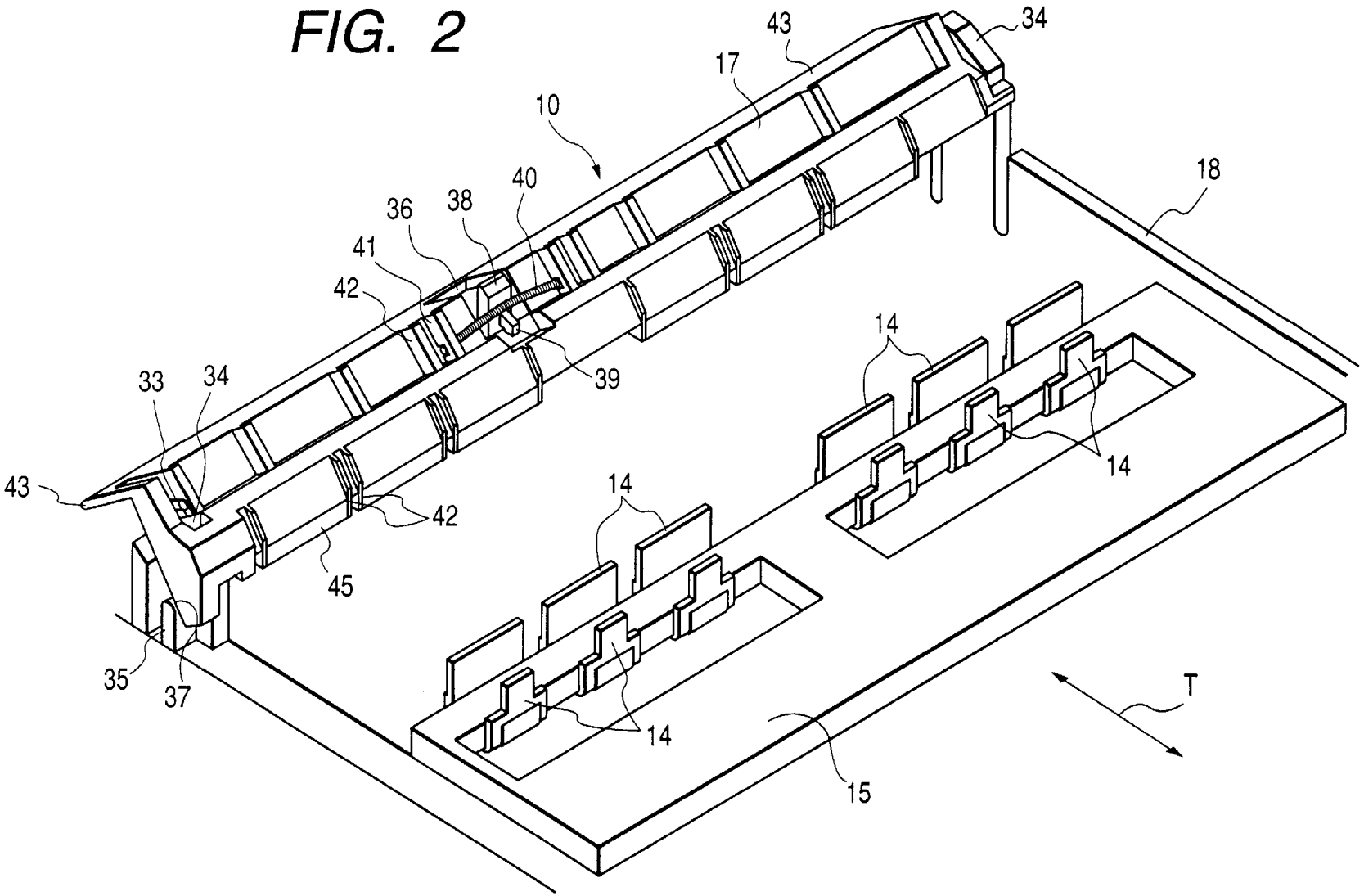
FIG. 2 is a typical perspective view showing the cleaning device of the ink jet recording apparatus of FIG. 1 as it is seen from above it.
Figure 3:
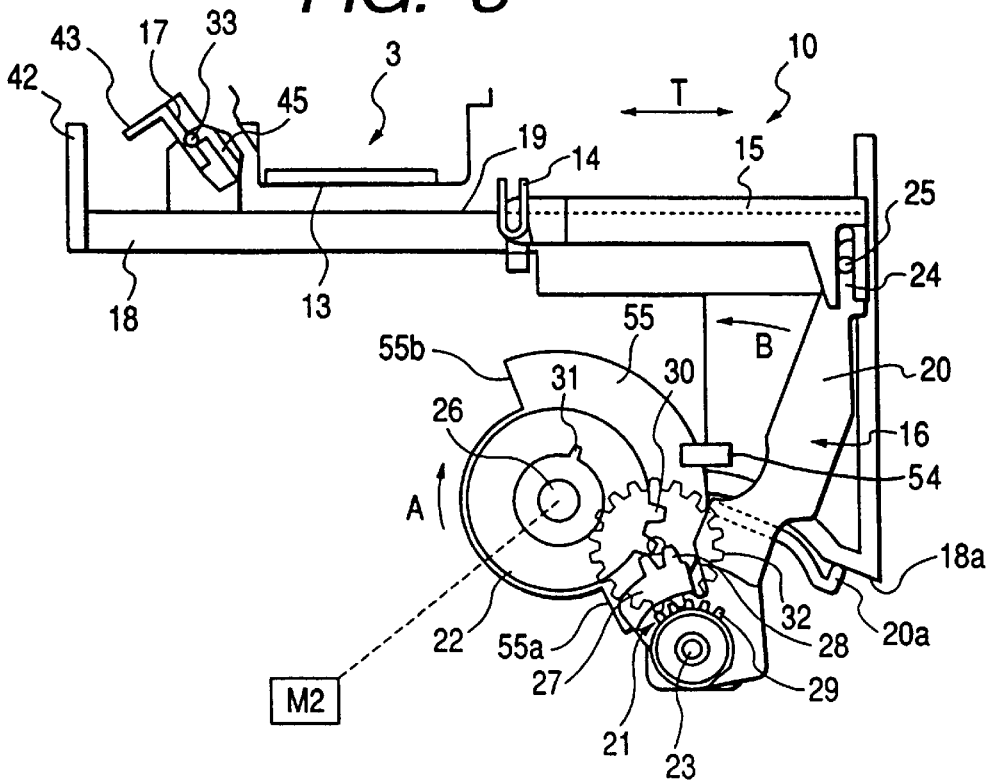
FIG. 3 is a typical side view showing the state before the start of the cleaning operation of the cleaning device in the recovery system of the ink jet recording apparatus according to the present invention.

In FIGS. 1 to 3, the ink jet recording apparatus 1 is provided with a driving motor Ml which is a drive source, a carriage 2 carrying ink jet recording heads 3 thereon, a transmission mechanism 4 for reciprocally moving the carriage 2 by a drive motor M, a paper supply mechanism (paper feed mechanism) 5 for conveying (feeding) recording paper P which is a recording medium, and a cleaning device 10 for cleaning (wiping) a discharge port surface to effect the discharge recovering process for the recording heads 3. In such an ink jet recording apparatus 1, the recording paper P is fed in by the paper supply roller 6 of the paper supply mechanism 5, and predetermined recording is effected on the recording paper P on a platen 7 by the recording heads 3.

An ink jet cartridge 8 mounted on the carriage 2 comprises the recording heads 3 and ink tanks 9 made into a unit, and is removably held (mounted) on the carriage 2 which is a member on which the recording heads are carried. Ink contained in the ink tanks 9 is supplied to the recording heads 3. In this case, the carriage 2 and the recording heads 3 can achieve and maintain required electrical connection therebetween by the joined surfaces thereof being properly brought into contact with each other.

The recording heads 3 are ink jet recording heads for selectively discharging ink from a plurality of discharge ports to thereby effect recording by applying energy in conformity with a recording signal. Also, these recording heads 3 are ink jet recording means utilizing heat energy to discharge ink, and are provided with electro-thermal converting members for generating heat energy. Further, the recording heads 3 utilize a pressure change caused by the growth and contraction of an air bubble due to film boiling created by heat energy applied by the electro-thermal converting members to discharge ink from the discharge ports and effect recording. The electro-thermal converting members are provided correspondingly to respective ones of the discharge ports, and a pulse voltage is applied to a corresponding electro-thermal converting member in conformity with a recording signal to thereby cause ink to be discharged from a corresponding discharge port.

Figure 18:
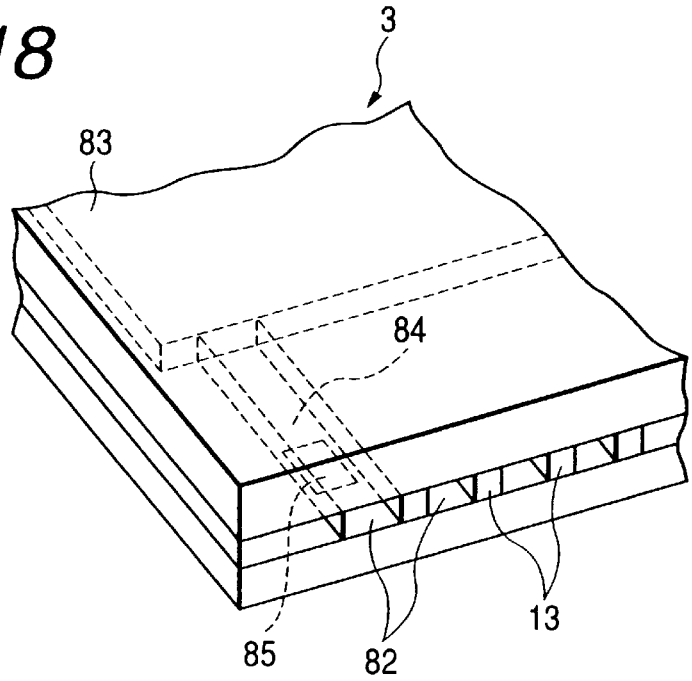
FIG. 18 is a fragmentary perspective view typically showing the structure of the ink discharging portion of recording means in FIG. 1.

FIG. 18 is a fragmentary perspective view typically showing the structure of the ink discharging portion (a row of discharge ports) of the recording means (recording heads) 3. In FIG. 18, a discharge port surface 13 facing a recording medium (such as recording paper) P with a predetermined gap (e.g., about 0.3 mm to 2.0 mm) therebetween is formed with a plurality of discharge ports 82 at a predetermined pitch, and an electro-thermal converting member (heat generating resistance member or the like) 85 for generating ink discharging energy is disposed along the wall surface of each liquid path 84 communicating each discharge port 82 with a common liquid chamber 83. The recording heads 3 are guided and supported in such positional relationship that the discharge ports 82 are arranged in a direction intersecting with a main scanning movement direction (in the present embodiment wherein the recording heads are carried on the carriage 2, the direction of movement of the carriage 2). Thus, there is constructed recording means (recording heads) 3 in which on the basis of an image signal or a discharge signal, a corresponding electro-thermal converting member 85 is driven (a pulse voltage is applied thereto) to thereby film-boil the ink in the liquid path 84 and by the pressure produced at that time, an ink droplet is discharged from the discharge port 82.

In FIG. 1, the carriage 2 is connected to a portion of the driving belt 11 of the transmission mechanism 4 for transmitting the driving force of the drive motor M, is guided and supported for sliding in the main scanning direction along two (or one) guide shafts 12 provided in parallelism to each other, and is mounted so as to be driven by the drive motor M. Accordingly, the carriage 2 is reciprocally moved along the guide shafts 12 by the forward rotation and reverse rotation of the drive motor M.

In the illustrated ink jet recording apparatus 1, the platen 7 is provided in opposed relationship with the discharge port surface 13 formed with the discharge ports of the recording heads 3, and the carriage 2 carrying the recording heads 3 thereon is reciprocally driven by the driving force of the drive motor M and at the same time, a recording signal is given to the recording heads 3 to discharge ink, whereby recording is effected over the full width of the recording paper P as a recording medium conveyed onto the platen 7.

Also, in such an ink jet recording apparatus 7, it has been practised to dispose a recovery device for recovering the bad discharging of the recording heads 3 at a desired position (for example, a position corresponding to the home position) outside the range of reciprocal movement (outside a recording area) for the recording operation of the carriage 2 carrying the recording heads 3 thereon. Such a recovery device is generally provided with a cap member for capping the discharge port surface 13 of the recording heads 3, and in operative association with the capping of the discharge port surface 13 by this capping member, ink is forcibly discharged from the discharge ports by sucking means (such as a suction pump) in the recovery device, whereby the discharge recovering process such as removing viscosity-increased ink, an air bubble, etc. in the ink flow path of the recording heads 3. Also, during non-recording or the like, the discharge port surface 13 of the recording heads 3 can be capped to thereby protect the recording heads and also prevent the drying of the ink.

In FIGS. 1 to 3, the cleaning device 10 can be provided, for example, together with the recovery device or at a position corresponding to the home position at which the recovery device is disposed. This cleaning device 10 is provided with a blade 14 as a wiping member for wiping and cleaning the discharge port surface 13 of the recording heads 3, a blade holder 15 supporting the blade 14 and movable along a guide portion 19 (FIG. 3), and an operating mechanism 16 for reciprocally operating the blade holder 15. The blade 14 for cleaning the discharge port surface 13 of the recording heads 3 is formed of an elastic material such as rubber and is held as such a form as shown on one end of the blade holder 15. This blade 14, like the aforedescribed recovery device, is operated by a suitable motor and a transmission mechanism, whereby it is urged against the discharge port surface 13 of the recording head 3 and wipes and cleans the discharge port surface.

Accordingly, after the recording by the recording heads 3, the recording heads 3 are located at the home position and the cleaning device 10 is moved relative to the recording heads and the blade is urged against and slidden relative to the discharge port surface 13, whereby the adherence, condensation and wetting of the ink or the like or dust such as paper powder on the discharge port surface can be wiped off, whereby the discharge port surface 13 of the recording heads 3 can be cleaned.

In FIGS. 1 to 3, the carriage 2 carrying the recording heads 3 thereon is reciprocally moved in the main scanning direction indicated by double-headed arrow S in FIG. 1. The cleaning device 10 is disposed at the home position of the recording heads 3 to clean the discharge port surface 13 of the recording heads 3 on the carriage 2. The cleaning device 10 in the ink jet recording apparatus to which the present invention is applied is provided with a blade 14, a blade holder 15 supporting the blade 14 on one end thereof and reciprocally movable in the direction of double-headed arrow T (back and forth) along the guide portion 19 of a base 18, an operating mechanism for reciprocally operating the blade holder 15, and a pivotally movable blade cleaner 17 for cleaning the blade 14.

The blade 14 is mounted on the blade holder 15, which is guided so as to be parallel-moved (reciprocally moved) horizontally in FIG. 3 along the guide portion 19 of the base 18 supporting various parts. The illustrated blade 14 has a U-shaped cross-section and wipes and cleans the discharge port surface 13 of the recording head by the bifurcated tip end thereof. However, the form of the blade 14 is not restricted thereto, but may be one sheet or three or more sheets depending on the form and performance of the recording heads 3. Also, besides the U-shape, for example, a plurality of blades 14 may be arranged at predetermined intervals. Also, the blade 14 is made of a rubber-like elastic material such as synthetic rubber or silicone rubber, or a plastic material having required elasticity.

The blade holder 15 forms a flat rectangular plate-like shape and is formed with two openings, and has mounted thereon a number of (six in the illustrated example) blades 14 corresponding to the number of the recording heads 3 carried on the carriage 2, and is reciprocally driven in the direction of double-headed arrow T along the guide portion 19 of the base 18 by the operating mechanism 16.

In FIG. 3, the operating mechanism 16 for reciprocally driving the blade holder 15 is provided with a blade arm 20 pivotally supported on the base 18 by a pivot 23 and having one end thereof connected to the blade holder 15, and a gear mechanism 21 for transmitting a pivotally moving force from a drive gear 22 driven by a drive motor M2 shown by a block to the blade arm 20. The connection of the blade arm 20 to the blade holder 15 is done by the engagement between a slot 24 in the blade holder 15 and a pin 25 provided on the tip end of the blade arm 20.

The gear mechanism 21 for the transmitting the driving force of the drive motor M2 to the blade arm 20 is provided with a drive gear 22 driven by the motor M2, and a follower gear 27 for pivotally moving the blade arm 20. The follower gear 27 is constituted by a forwardly moving gear member 28 for forwardly moving the blade holder 15 and a backwardly moving gear member 29 for backwardly moving the blade holder 15, both gear members 28 and 29 being integrally mounted on the pivot 23 pivotally supporting the blade arm 20. The drive gear 22 driven by the drive motor M2 is provided with a gear member 30 meshing with the forwardly moving gear member 28 and a gear member 31 meshing with (gear-connected to) the backwardly moving gear member 29 through an idle gear 32 to reversely drive the backwardly moving gear member 29, correspondingly to respective ones of the gear members 28 and 29 of the follower gear 27, and a flag 55. An optical sensor 54 is fixed to the base 18, and this optical sensor 54 is turned on/off by the action of the flag 55 resulting from the rotation of the drive gear 22.

Further, the gear members 28 and 29 on the blade arm 20 side and the gear members 30 and 31 on the drive gear 22 side are toothed only on their necessary portions so that only when necessary, the drive force may be transmitted to the blade arm 20. Design is made such that the drive gear 22 is rotated in one direction to thereby reciprocally pivotally move the blade arm 20 and reciprocally parallel-move the blade holder 15 and the blade 14 through the slot 24 and the pin 25. Due to such a driving mechanism, by only the rotation of the drive motor M2 and the drive gear 22 in one direction, the driving frequency of the drive motor M2 is suitably selected, whereby the blade holder 15 and the blade 14 can be moved at any speed during forward movement and during backward movement.

In FIGS. 2 and 3, a blade cleaner 17 for wiping off any ink adhering to the blade 14 and cleaning the blade 14 is pivotally supported on the base 18. The blade cleaner 17 has a substantially dog-legged cross-section and is provided with shaft portions 33 on the opposite end portions thereof. This blade cleaner 17 is pivotally mounted by its shaft portions 33 fitted to bearing portions 34 on the opposite sides of the base 18. On the other hand, the base 18 is provided with a stopper 35 which permits the blade cleaner to pivotally move in one direction, but prevents the blade cleaner from pivotally moving in the other direction. This stopper 35 dashes against the dash portion 37 of the blade cleaner 17 to thereby prevent any further pivotal movement (clockwise pivotal movement about the shaft portions 33 as viewed in FIG. 3) of the blade cleaner 17.

Figure 8A:
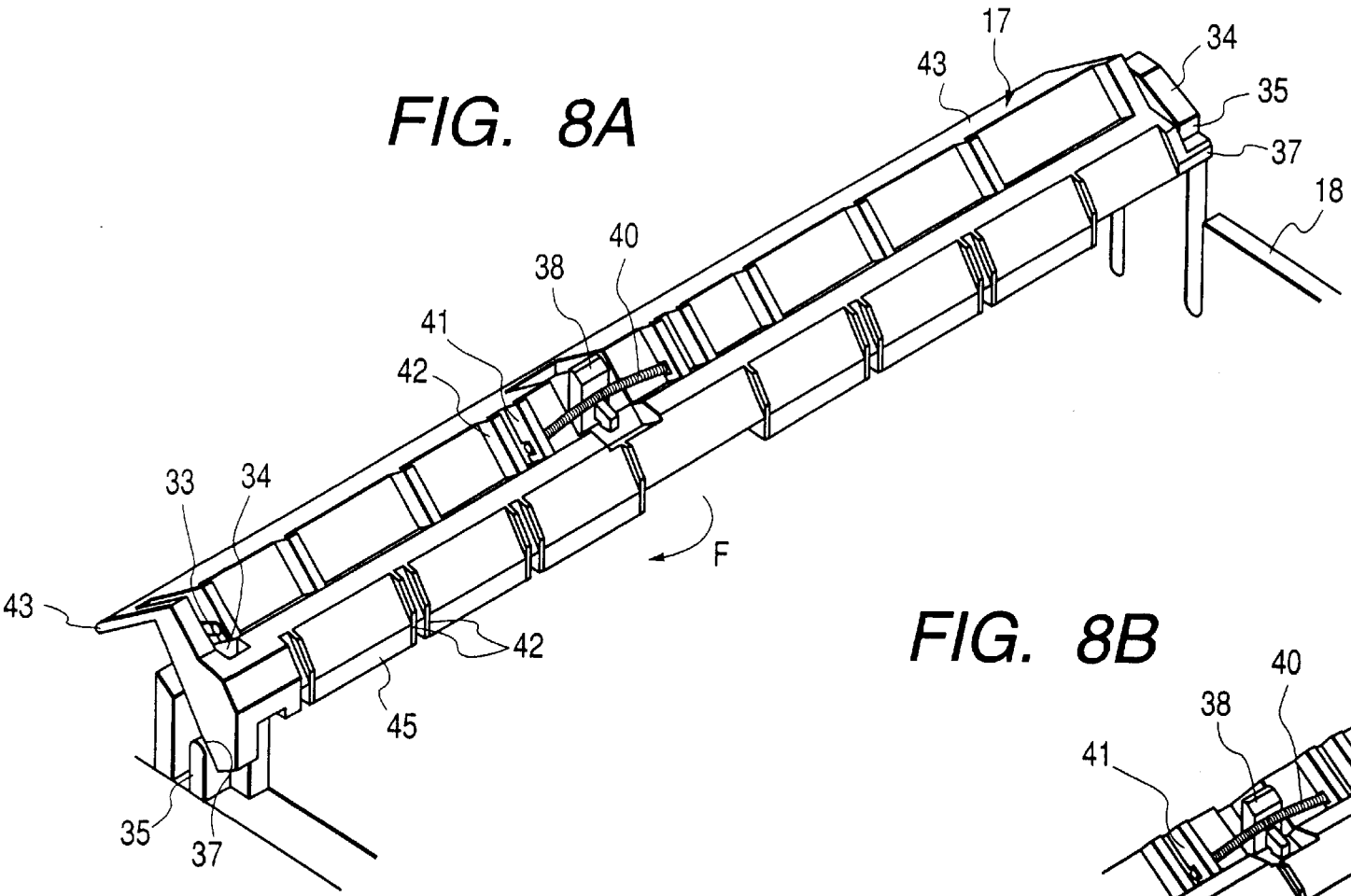
FIGS. 8A and 8B are typical perspective views showing the state during the operation of a blade cleaner and the state of the central portion when the blade cleaner has been pivotally moved to its inoperative position.
Figure 8B:
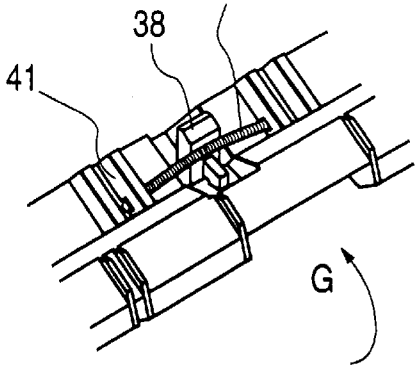

FIG. 8A is a typical perspective view showing the state during the operation of the blade cleaner 17, and FIG. 8B is a typical perspective view showing the state of the central portion of the blade cleaner 17 when the blade cleaner 17 has been pivotally moved to its inoperative position. In FIGS. 2 and 8A and 8B, a cut-away portion 36 is formed in the central portion of the blade cleaner 17, and a strut 38 extends from the base 18. This strut 38 contacts with the vicinity of the center of rotation of the blade cleaner 17 from above it to thereby support the central portion of the elongate blade cleaner 17 so that the rotational load thereof may become small. For this purpose, the contacting portion 39 of the strut 38 in the central portion of the blade cleaner 17 is made so as to become thin at the tip thereof like a rib.

A spring 40 is provided to bias the blade cleaner 17 so as to dash against the stopper 35. This spring 40 is made of an intimate contact coil spring and has its spring engagement portions at the opposite ends of an ordinary intimate contact coil tension spring removed. Such a spring 40 is placed on the upper side of the strut 38 in the central portion of the blade cleaner 17 and has its opposite end portions inserted in a mounting portion 41 provided on the wall 42 of the blade cleaner 17. The spring 40 has its opposite end portions mounted on the mounting portion 41 provided on the wall 42 of the blade cleaner 17 and does not move more than predetermined backlash in the axial direction and diametral direction of the spring 40, but yet the rotation of the spring is not regulated and the spring is made somewhat rotatable.

Also, the spring 40 is located above the center of rotation of the blade cleaner 17 and therefore, when the blade cleaner 17 is pivotally moved in the direction of arrow G as shown in FIG. 8B, the strut 48 and the spring mounting portion 41 for the blade cleaner 17 become spaced apart from each other and the mountain portion of the spring 40 in the mountain-like state thereof becomes high and the amount of deformation of the spring 40 is increased and accordingly, the reaction force of the spring 40 increases. Also, the blade cleaner 17 having a substantially dog-legged cross-sectional shape is provided with a visor-like screen portion 43 for preventing the upward scattering of ink, whereby the scattering of the ink can be suitably and effectively prevented.

In FIG. 3, the upper end of the blade 14 of the cleaning device 10 is made higher by a predetermined amount (e.g., the order of 0.1 mm to 2.0 mm) than the discharge port surface 13 of the recording apparatus 1 and the underside of the blade cleaner 17, and a predetermined amount of overlap allowance (interference allowance) is provided. Also, in order to pivotally move the blade cleaner 17 lightly, the bearing portion thereof (indicated at 34 in FIG. 2) is provided with a little much backlash (e.g., of the order of about 0.05 mm to 0.5 mm). Also, FIG. 10 is a cam graph in which the axis of abscissas indicate the cam angle when the edge 55*a* of a flag 55 on the cam from light-passing to light-shielding is the standard.

Figure 4:
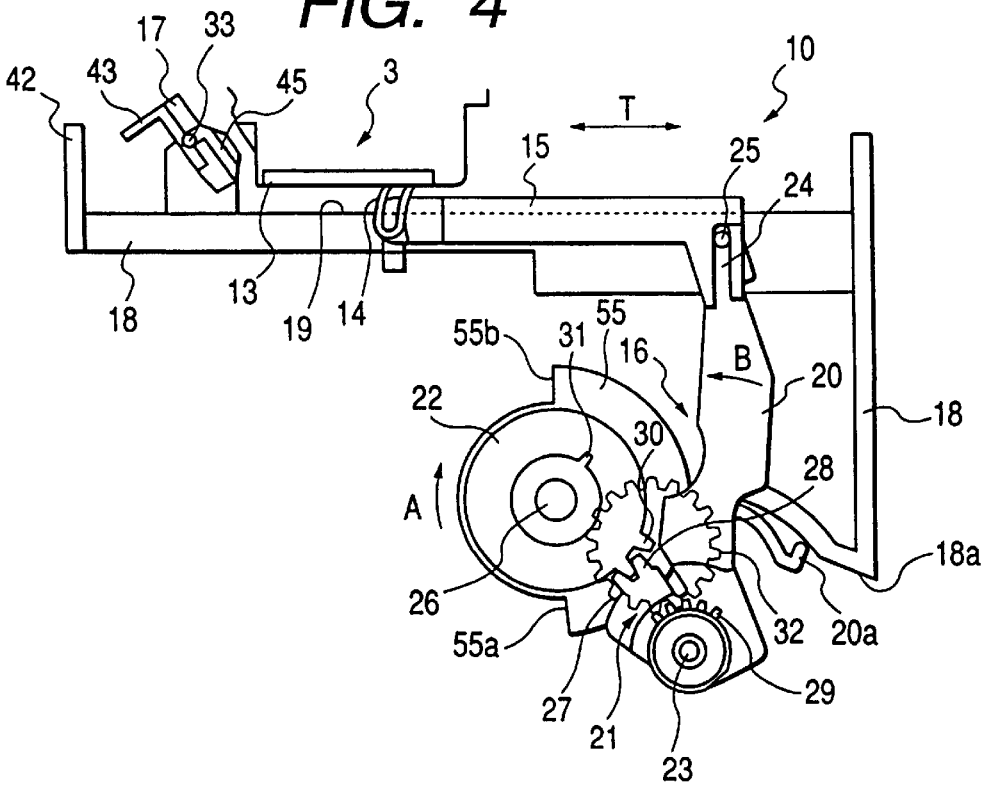
FIG. 4 is a typical side view showing the state during the wiping operation of the cleaning device in the recovery system of the ink jet recording apparatus according to the present invention for a discharge port surface.
Figure 5:
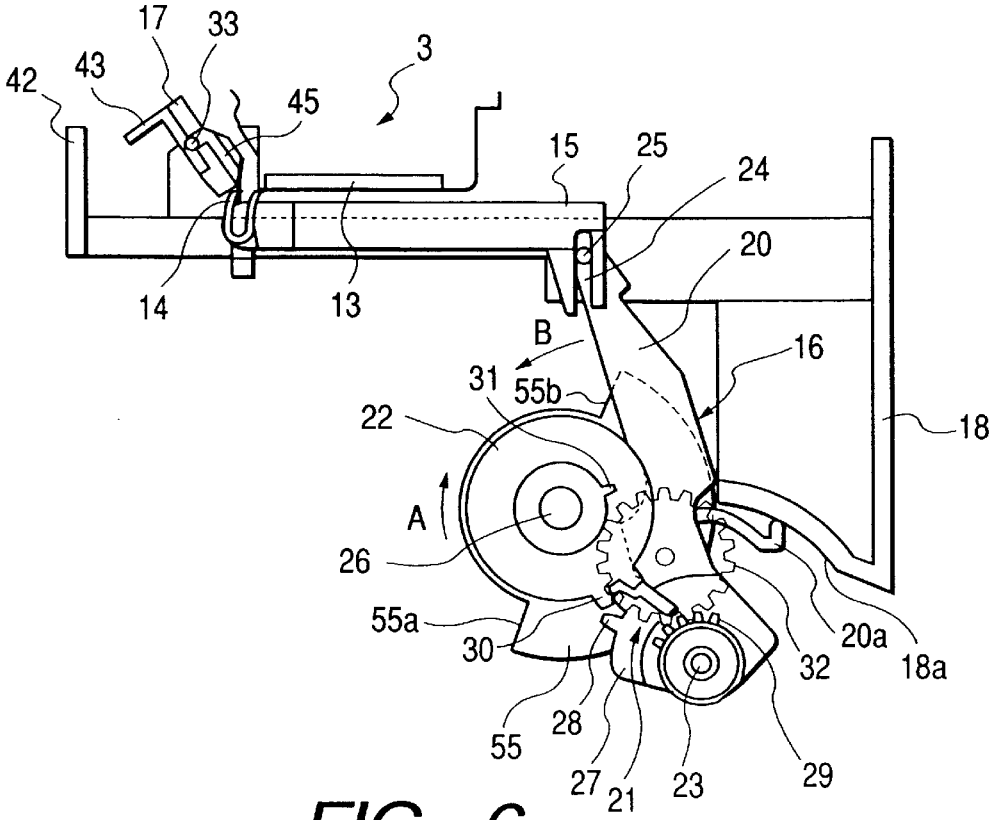
FIG. 5 is a typical side view showing the state at the end of the wiping operation of the cleaning device of FIG. 4 for the discharge port surface.
Figure 6:
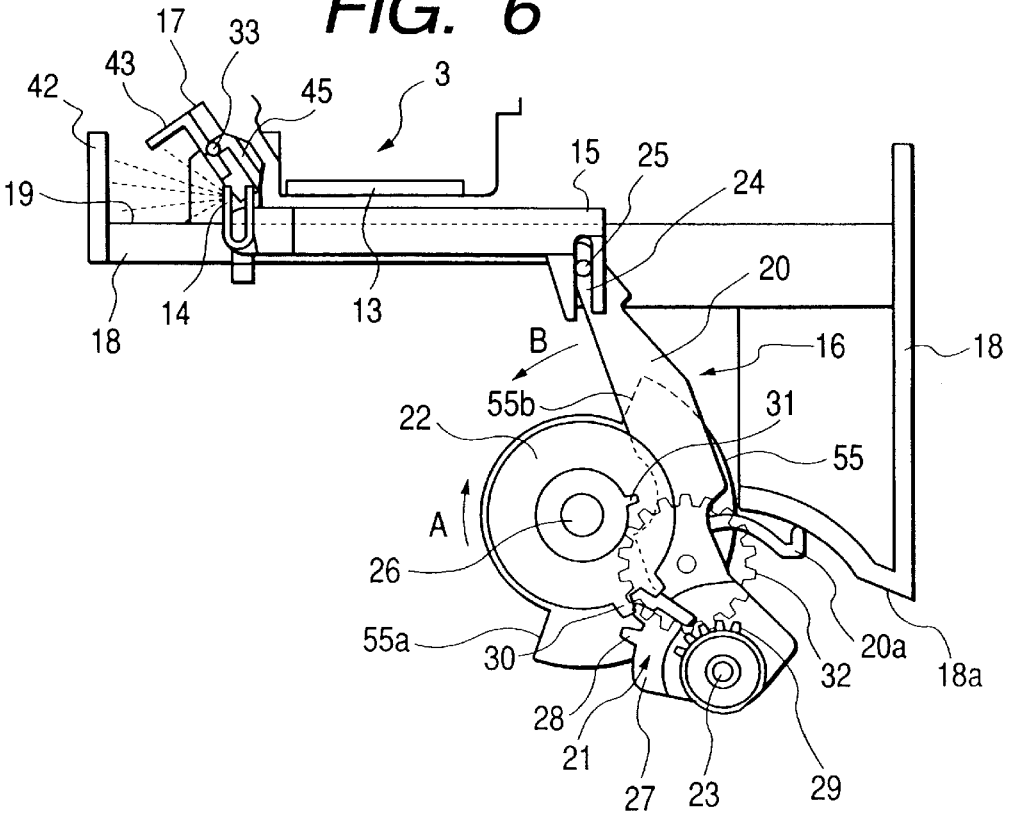
FIG. 6 is a typical side view showing the state during the blade cleaning after the termination of the wiping operation for the discharge port surface by the cleaning device of FIG. 4.
Figure 7:
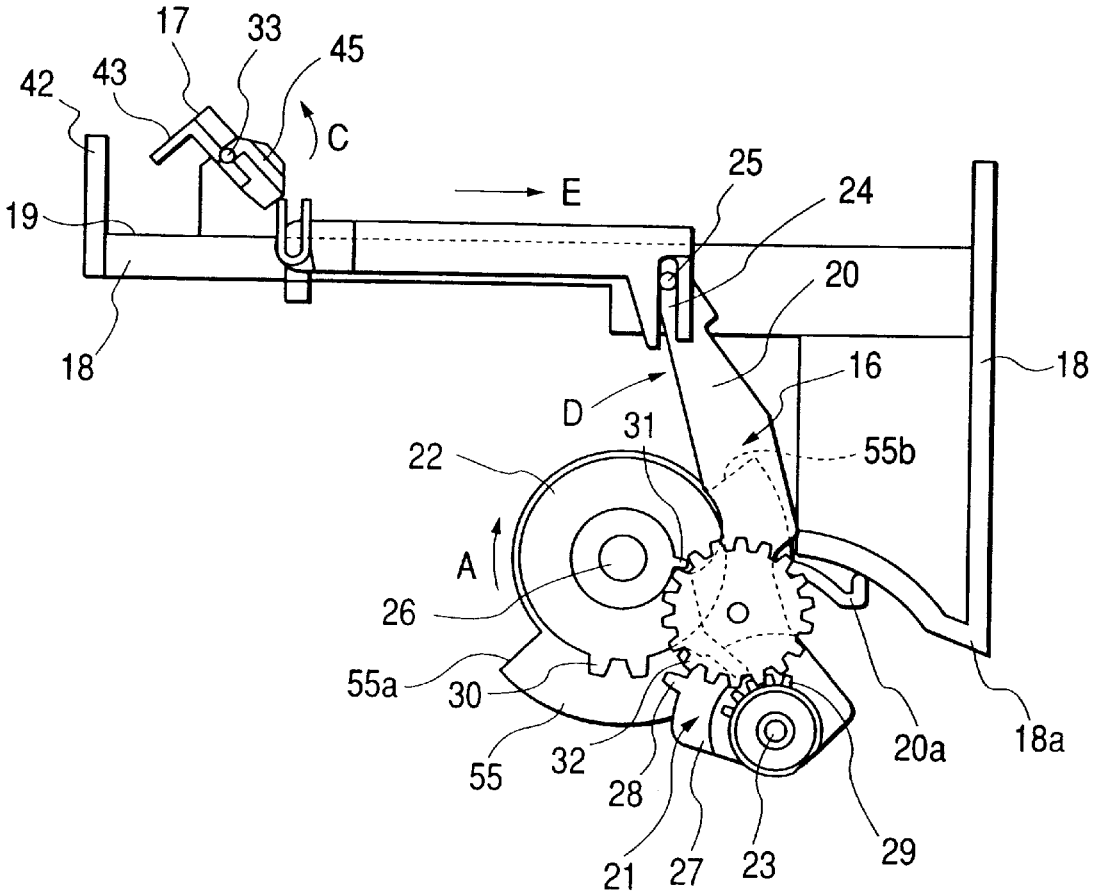
FIG. 7 is a typical side view showing the state during the return of a blade holder after the termination of the blade cleaning by the cleaning device of FIG. 4.

FIG. 4 is a typical side view showing the state during the discharge port surface wiping operation of the cleaning device (the cleaning device of FIG. 3) of the recovery system of the ink jet recording apparatus according to the present invention, FIG. 5 is a typical side view showing the state at the end of the discharge port surface wiping operation of the cleaning device of FIG. 4, FIG. 6 is a typical side view showing the state during the blade cleaning after the termination of the discharge port surface wiping operation of the cleaning device of FIG. 4, and FIG. 7 is a typical side view showing the state during the return of the blade holder after the termination of the blade cleaning operation of the cleaning device of FIG. 4. The operation of the cleaning device 10 (particularly the operation of the blade 14) of the recovery system of the ink jet recording apparatus according to the present invention will hereinafter be described with reference to FIGS. 3 to 7.

The blade 14 is first moved from the state of FIG. 3 to the left as viewed in FIG. 3 to thereby wipe off any ink and stain adhering to the discharge port surface 13 of the recording heads 3 as shown in FIG. 4 and clean the discharge port surface 13. That is, when the blade holder 15 is moved forwardly in the direction of arrow T along the guide portion 19 of the base 18, the end portion of the blade 14 wipes the discharge port surface 13 of the recording heads 3, whereby any ink and stain adhering to the discharge port surface 13 are removed and the discharge port surface 13 is cleaned. That is, the cleaning of the discharge port surface 13 is effected.

Figure 9:
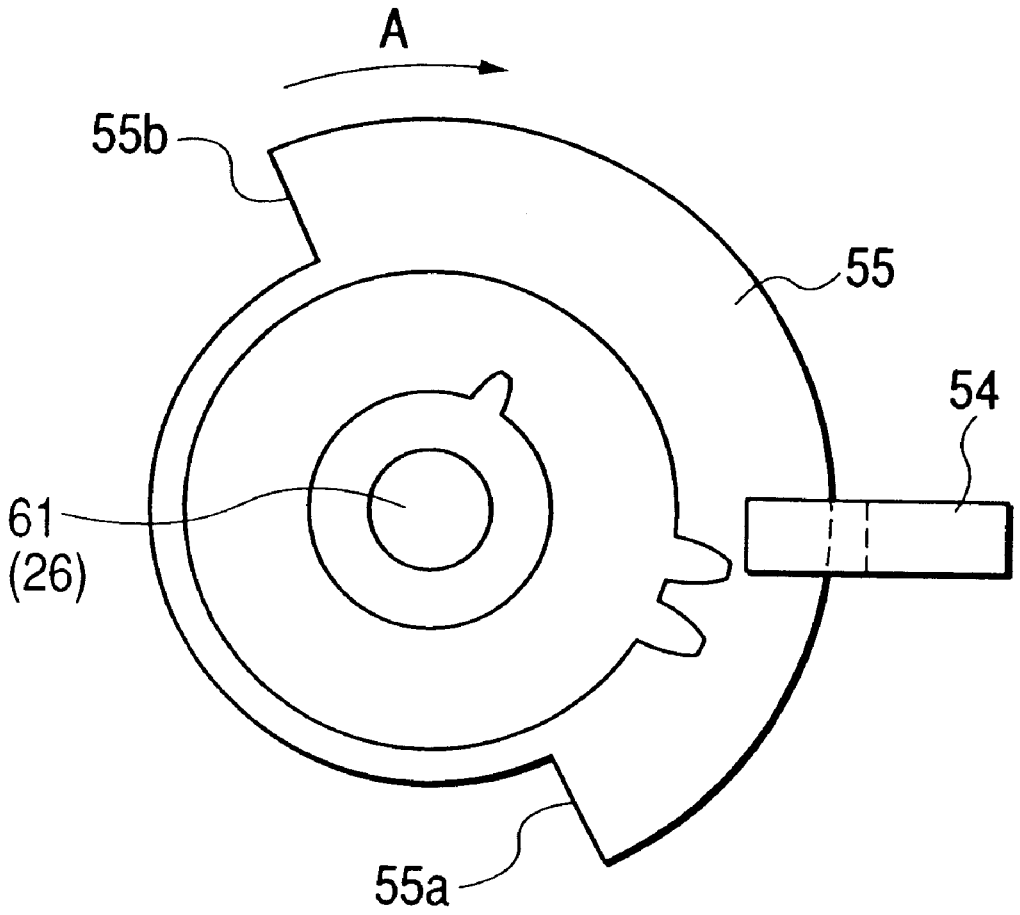
FIG. 9 is a fragmentary front view showing the positional relation between a flag mounted on the same shaft of the cam of the recovery system of the ink jet recording apparatus according to the present invention and an optical sensor.
Figure 10:
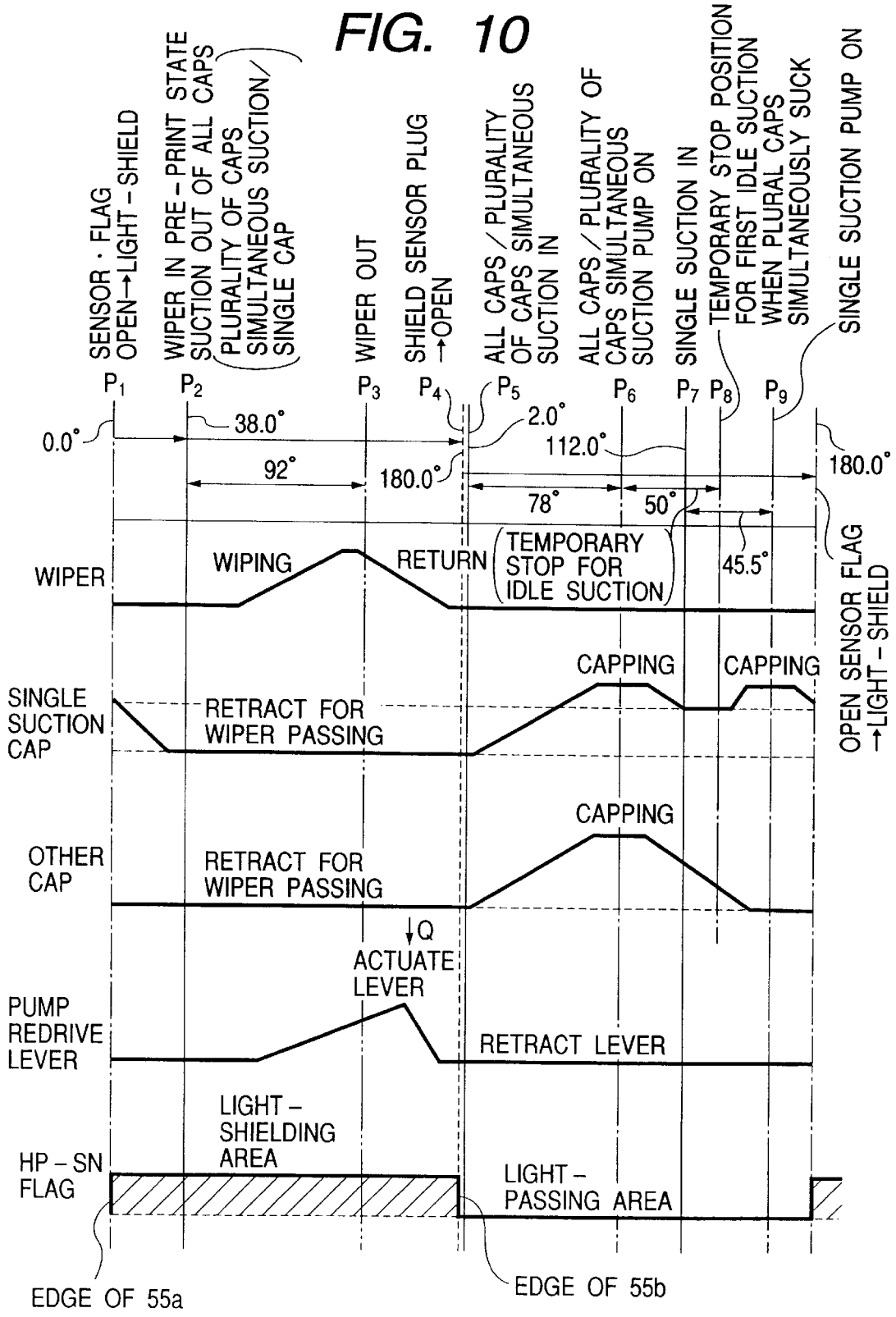
FIG. 10 is a cam graph showing the relation between the phase and operation of the cam of the recovery system of the ink jet recording apparatus according to the present invention.
Figure 11:
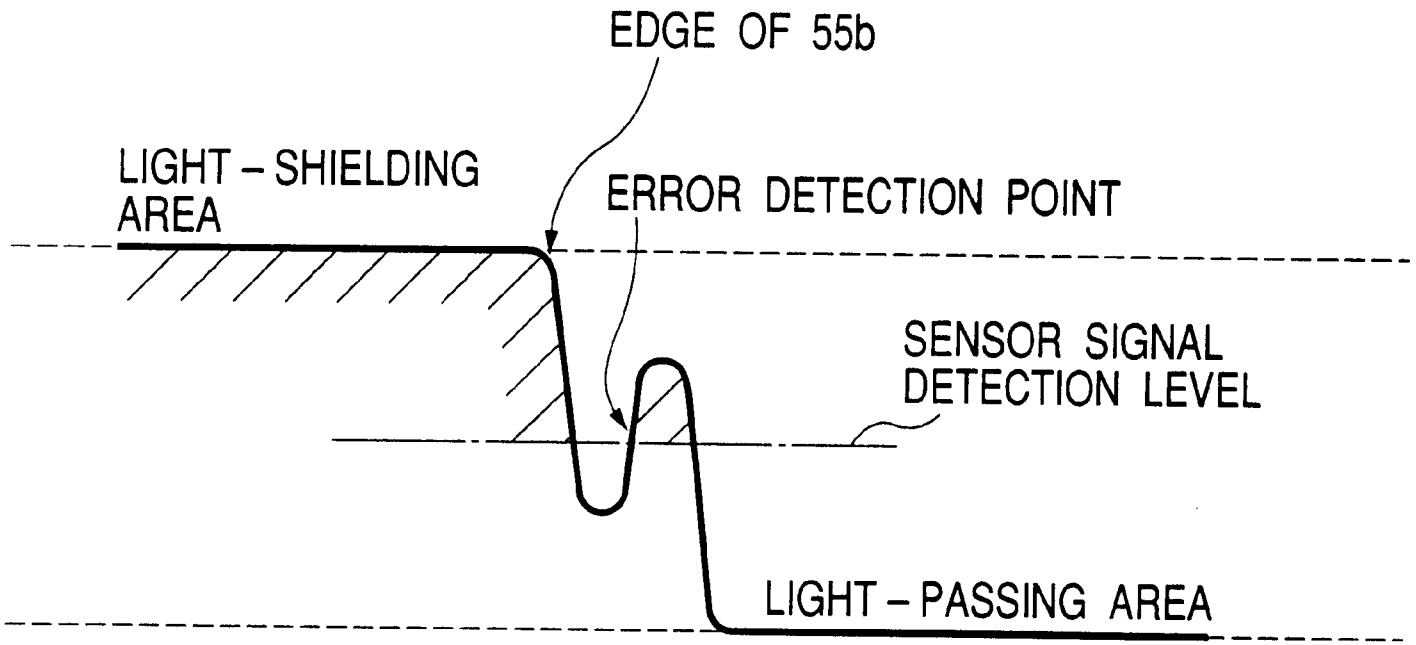
FIG. 11 is a typical view illustrating a sensor signal in light-shielding and light-passing states at an edge which become the cause of the erroneous detection of the flag.

FIG. 9 is a fragmentary front view showing the positional relation between a flag 55 mounted coaxially with the cam of the recovery system of the ink jet recording apparatus according to the present invention and an optical sensor 54, FIG. 10 is a cam graph showing the relation between the phase and operation of the cam of the recovery system of the ink jet recording apparatus according to the present invention, and FIG. 11 is a typical view illustrating a sensor signal in the light-shielding and light-passing states at an edge which becomes the cause of the wrong detection of the flag.

First, on the cam graph of FIG. 10, the cam in the state before recording is rotated to detect an edge 55*b* which becomes light-shielding to light-passing for the flag 55, and the cam is rotated by a predetermined angle from there and is stopped for a moment. Thereafter, the cam is again rotated, and now an edge 55*a* which becomes light-passing to light-shielding for the flag 55 is detected, and the cam is rotated by 38° from there, and the cam is positioned at the wiper-in position shown in FIGS. 3 and 9. The reason why the detection of the edge 55*a* is not done at a stroke in this series of flows is that if after the passage through the edge 55*b*, the cam effects unstable movement and there is a signal output as shown in FIG. 11, it is erroneously detected that the edge 55*b* which should originally become light-shielding to light-passing is the edge 55*a* which becomes light-passing to light-shielding at an erroneous detection point.

Such movement of the blade 14 is effected by the drive gear 22 being driven by a drive motor, not shown, and the gear member 30 for forward movement of the drive gear 22 driving the gear member 28 for forward movement of the blade arm 20. As previously described, the drive gear 22 is comprised of the gear member 30 for forward movement and the gear member 31 for backward movement integrally provided on the motor shaft 26, and on the other hand, the gear member 28 for forward movement and the gear member 29 for backward movement are integrally provided on the pivot 23 of the blade arm 20.

Therefore, when the drive gear 22 is rotated in the direction of arrow A from the state of FIG. 3, the gear members 30 and 28 for forward movement come into meshing engagement with each other and the blade arm 20 is pivotally moved in the direction of arrow B and therefore, the blade 14 is moved to the left as viewed in FIG. 3 into the state of FIG. 4, and the wiping operation of the blade 14 for the discharge port surface 13 of the recording head 3 is started. Also, the movement speed of the blade 14 during the above-described head wiping operation is defined as P.

When the drive gear 22 is then further rotated in the direction of arrow A, the blade 14 wipes and passes the whole of the discharge port surface 13, and thereafter strikes against the cleaning portion 45 of the blade cleaner 17. At this time, the blade cleaner 17 does not pivotally move with the dash portion 37 thereof striking against the stopper 35 and therefore, the blade 14 passes through the cleaning portion 45 while flexing as shown in FIG. 5. At this time, ink, etc. adhering to the end of the blade 14 are wiped off by the blade cleaner 17 and thus, the blade 14 is cleaned. In this case, cleaning takes place only on the end portion of the blade 14 and therefore, much ink still adheres to the entire blade 14, but to cleanly wipe the discharge port surface 13 of the recording heads 3, it is enough if the end portion of the blade 14 is clean and accordingly, functionally the above-described cleaning operation is enough.

When the blade 14 passes through the blade cleaner 17, the blade 14 having so far flexed is liberated and returns to its original state (restores to its original state) and therefore, at that time, the residual ink adhering to the blade 14 scatters to the left as shown in FIG. 6. To prevent the contamination of the interior of the recording apparatus by such scattering of the ink, a wall 42 for receiving the scattering ink may preferably be provided at a left position of the blade cleaner 17 as nearest as possible to the blade cleaner. It is also very effective to extent the visor-like screen portion 43 from the blade cleaner 14.

When the drive gear 22 is further rotated in the direction of arrow A, the meshing engagement between the gear member 30 for forward movement of the drive gear 22 and the gear member 28 for forward movement of the blade arm 20 is released as shown in FIG. 7, and now the gear member 31 for backward movement of the drive gear 22 comes into meshing engagement with the gear member 29 for backward movement of the blade arm 20 through the idle gear 32 and thus, transmits a driving force. Accordingly, the blade arm 20 begins to pivotally move in the direction of arrow D which is opposite to the direction in which it has so far pivotally moved. Therefore, the blade holder 15 and the blade 14 also begin to be moved in the direction of arrow E (FIG. 7) which is opposite to the direction in which they have so far been moved. In this case, when the blade 14 passes below the blade cleaner 17, the blade cleaner 17 now pivotally moves in the direction of arrow C (FIG. 7) and thus, the blade cleaner 17 escapes and avoids the blade 14 by an amount over which they overlap each other.

That is, the blade 14 pushes the blade cleaner 17 aside and passes. Accordingly, the scattering of the ink is greatly mitigated. It is because the blade 14 is slightly flexed by an amount corresponding to the force with which the blade cleaner 17 is biased by the spring 40 that the scattering of the ink does not become completely null. Here, the movement speed of the blade 14 from after the blade 14 strikes against the cleaning portion 45 as shown in FIG. 5 until it turns its direction and restores the opposite direction and pushes the blade cleaner 17 aside and passes as shown in FIG. 7 is defined as Q.

If the rotation of the gear 22 in the direction of arrow A is intactly continued, the blade 14 returns to the state of FIG. 3 and thus, one cycle of cleaning operation (one cycle of wiping operation) is terminated. At this time, the gear member 30 for forward movement of the drive gear 22 becomes separate and free from the gear member 28 for forward movement of the blade arm 20, but since the arm portion 20*a* of the blade arm 20 which has elasticity is located in the valley portion of the cam 18*a* of the base 18, it never happens that the blade arm 20 inadvertently moves from the position of FIG. 3.

As described above, the reciprocal movement of the blade 14 is effected by only the rotation of the drive motor (not shown) in one direction and therefore, the cleaning (wiping) of the discharge port surface 13 of the recording heads 3 and the cleaning of the blade 14 itself (the blade cleaning operation) can be executed easily and properly at one step. However, the driving of the blade 14 as described previously may be done by the forward and reverse rotation of the drive motor, and may also be done by the use of an actuator of a parallel movable type such as a solenoid. Here, the previously prescribed wiping speed P is usually set to a relatively low speed with importance attached to the wiping property of the discharge port surface 13.

Also, the previously prescribed blade cleaning speed Q may be set to a somewhat high speed as compared with the wiping speed P although a very high speed is not desirable from the viewpoint of the prevention of the scattering of the ink. Further, defining the other speed than these speeds P and Q as R, it is desirable to set this speed R to a very high speed to speed up a series of recovering operations. Accordingly, the relation in magnitude among the above-mentioned speeds is P<Q<R.

Figure 12:
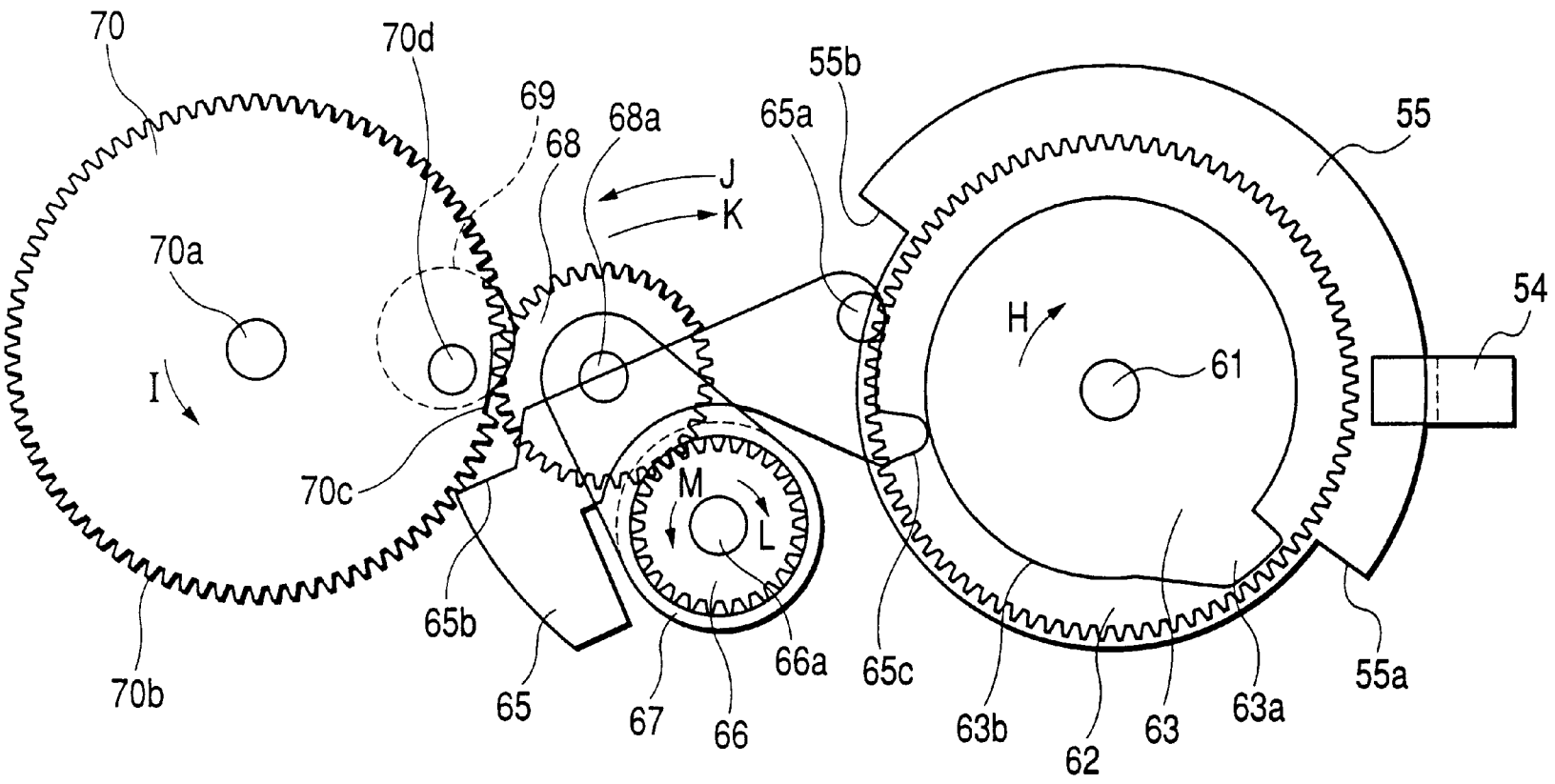
FIG. 12 is a side view showing the inoperative state of a pump lever in the suction driving system of the recovery system according to the present invention.
Figure 13:
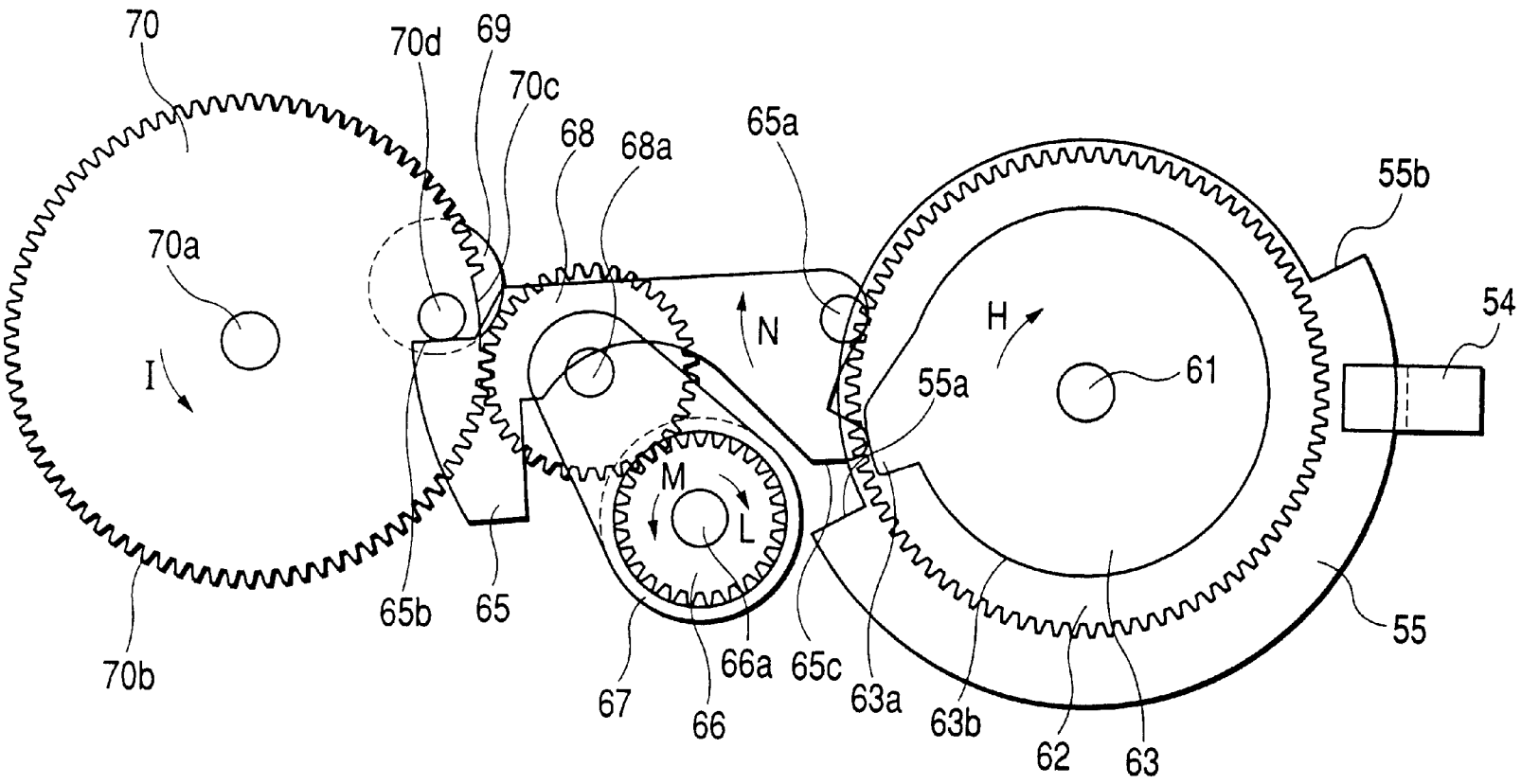
FIG. 13 is a side view showing the operative state of the pump lever in the suction driving system of FIG. 12.
Figure 14:
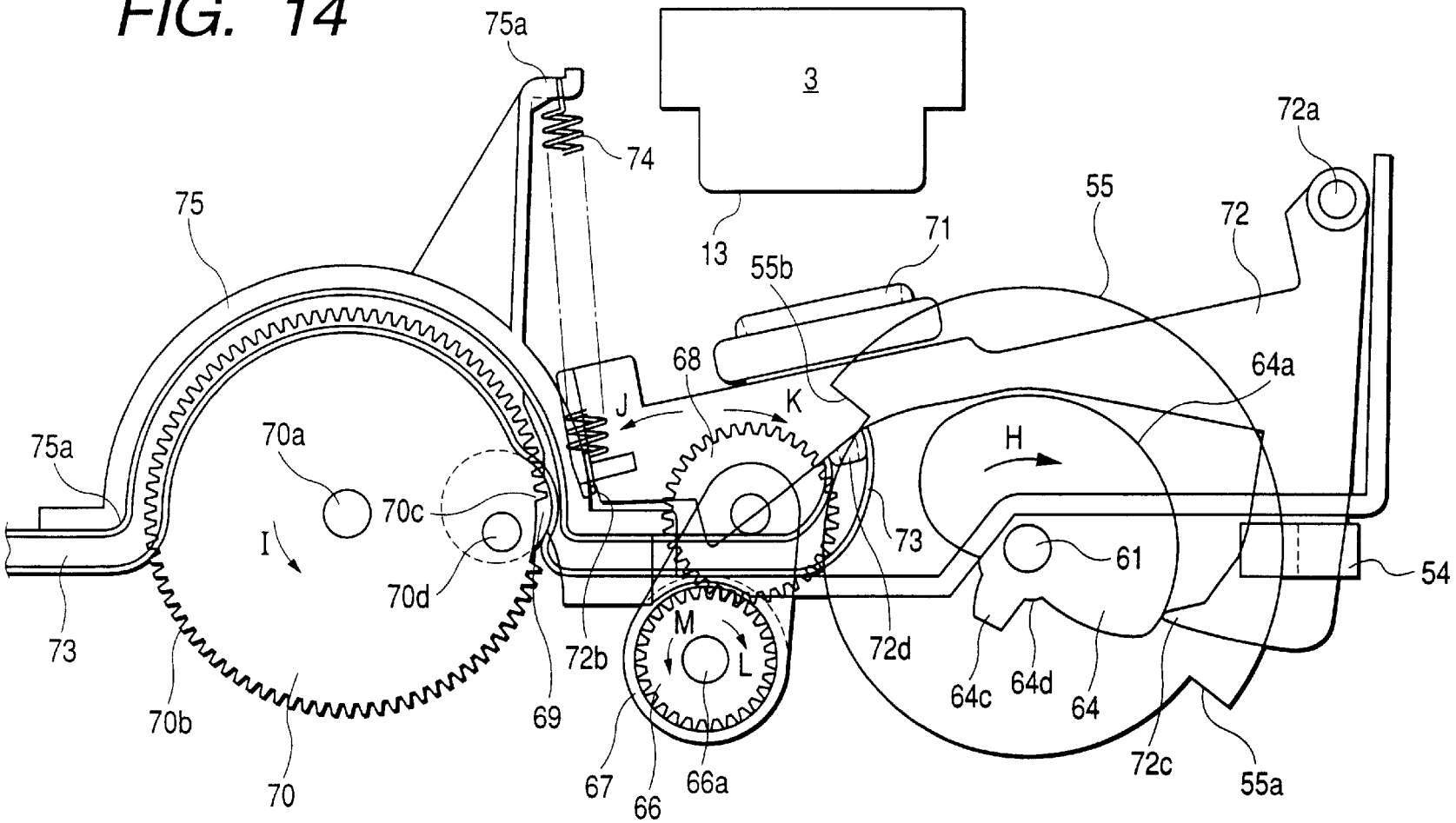
FIG. 14 is a side view showing the waiting state of each part in the suction driving system of FIG. 12.
Figure 15:
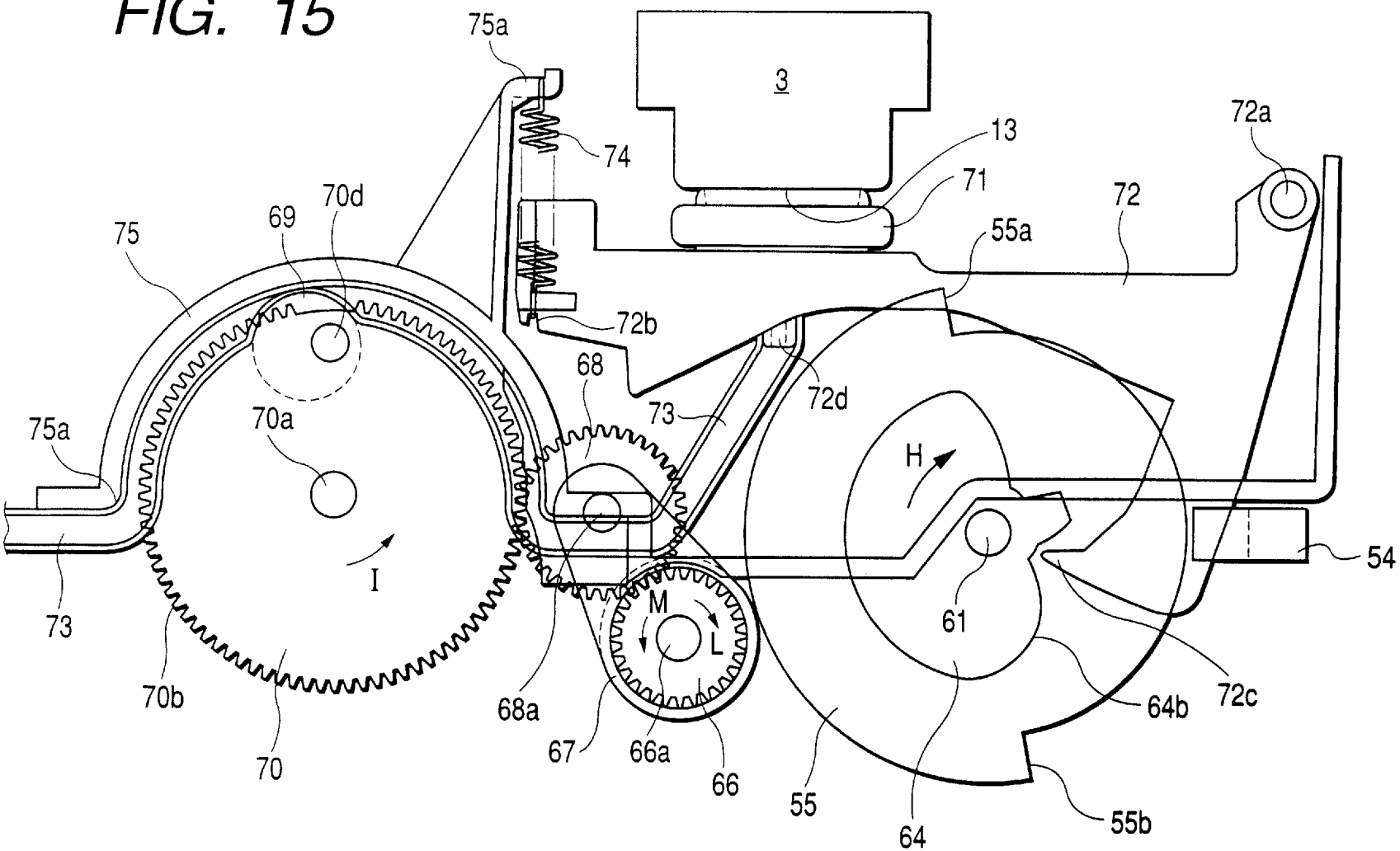
FIG. 15 is a side view showing the suction state of each part in the suction driving system of FIG. 12.
Figure 16:
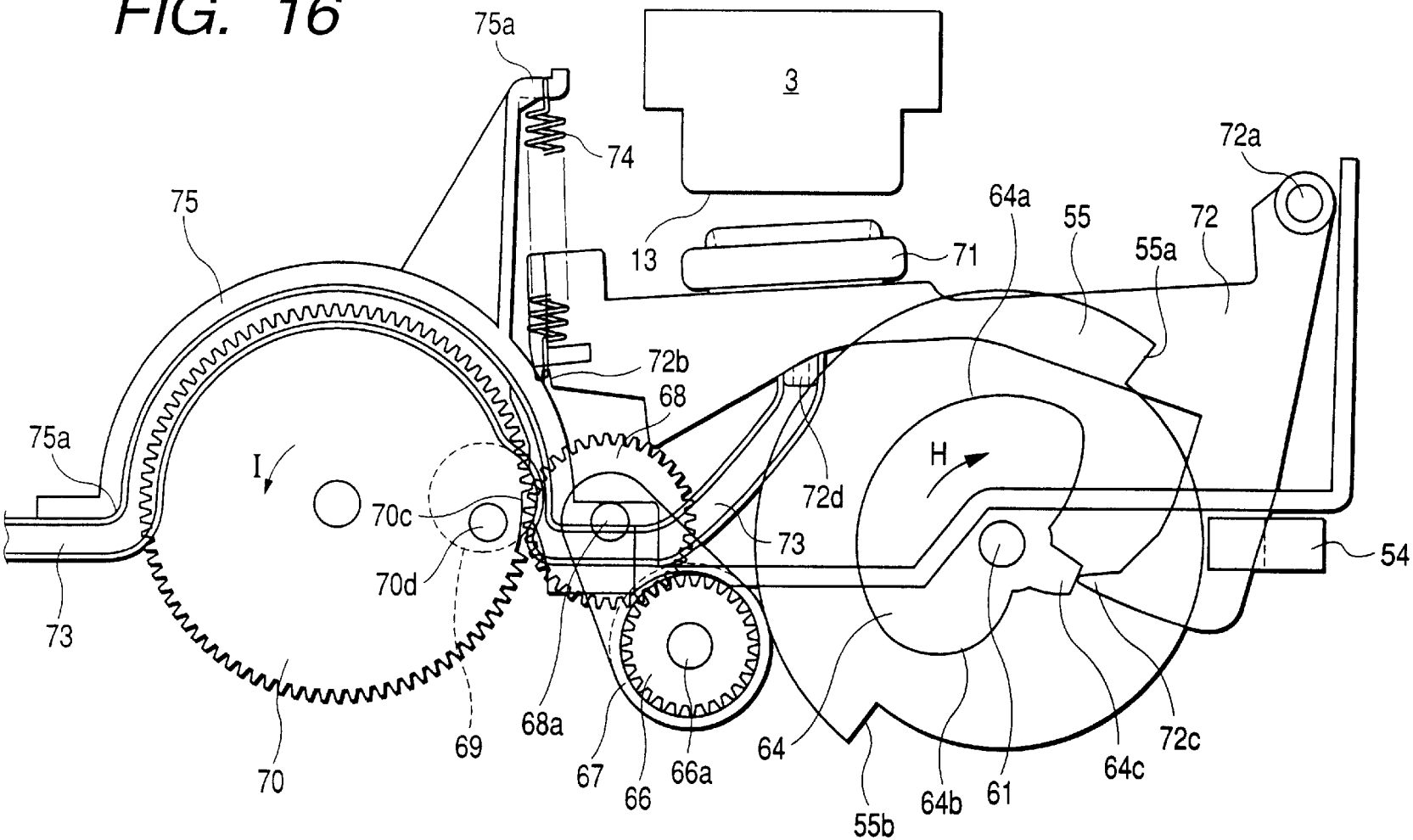
FIG. 16 is a side view showing the temporary stopped state of a cam for the discharge of ink in the cap of each part in the suction driving system of FIG. 12.
Figure 17:
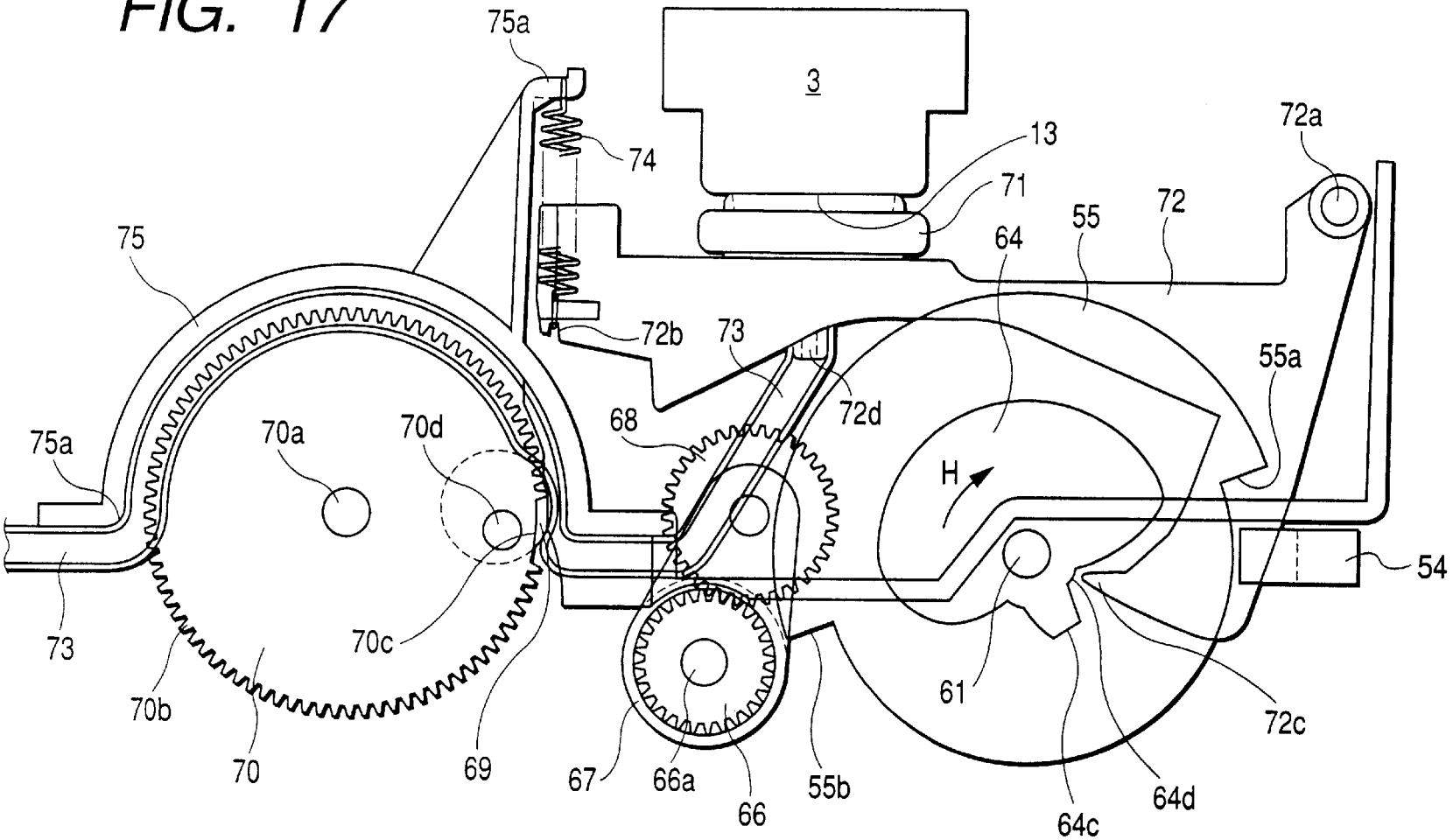
FIG. 17 is a side view showing the single suction and cap recontact states of each part in the suction driving system of FIG. 12.

FIG. 12 is a side view showing the inoperative state of a pump lever in the suction drive system of the recovery system according to the present invention, FIG. 13 is a side view showing the operative state of the pump lever in the suction drive system of FIG. 12, FIG. 14 is a side view showing the waiting state (the cam $P_2$ state in FIG. 10) of each part in the suction drive system of FIG. 12, FIG. 15 is a side view showing the suction state (the cam $P_6$ state in FIG. 10) of each part in the suction drive system of FIG. 12, FIG. 16 is a side view showing the cam temporarily stopped state (the cam $P_8$ state in FIG. 10) of each part in the suction drive system of FIG. 12 for the discharge of the ink in the cap, and FIG. 17 is a side view showing the single suction and cap recontact state (the cam $P_9$ state in FIG. 10) of each part in the suction drive system of FIG. 12.

The present invention is concerned with a recovery system in an ink jet recording apparatus wherein sucking means for effecting suction recovery is driven by the driving of a motor in one direction, and by the driving of the motor in the opposite direction, capping means for contacting a cap with and spacing it apart from the discharge port surface of recording means or both of the capping means and wiping means for wiping the discharge port surface are driven by a cam having a flag portion for position detection on the same shaft and cam phase detecting means, and which has, in addition, a characteristic construction as will hereinafter be described.

The suction recovery of the recovery system of the ink jet recording apparatus according to the present invention will now be described with reference to FIGS. 12 to 17 and FIG. 10. The same parts as the parts used in the previous description of the wiping (cleaning) operation are designated by the same reference numerals. In FIGS. 12 and 14, a cam shaft 61 is the same shaft as the motor shaft 26 in FIGS. 3 to 7, and this cam shaft 61 is coaxial with the aforedescribed gear members 30 and 31 (those described with regard to the wiping operation in FIGS. 3 to 7) and the flag 55, and a cam gear 62 and a lever cam 63 are disposed on this cam shaft, and an optical sensor 54 is disposed at a position whereat light can be intercepted by the flag 55.

Also, a pump lever 65 has its shaft 65*a* pivotally supported on a base 75, and the cam contacting portion 65*c* and holder contacting portion 65*b* thereof can contact with the lever cam 63 and a holder projection 70*d*, respectively. A roller 69 is supported by a holder 70 for sliding movement in the radial direction of the holder 70. The holder 70 has its shaft portion 70*a* rotatably supported on the base 75 and integrally has a gear 70*b* having a partly untoothed portion 70*c*, and a projection 70*d* capable of contacting with the pump lever 65 is further formed near the untoothed portion 70*c*. Also, a pendulum arm 67 is disposed in such a manner as to fit to the outer peripheral surface of a central gear 66 having its shaft portion 66*a* rotatably supported on the base 75, and a pendulum gear 68 having its shaft portion 68*a* supported on the pendulum arm 67 is disposed so as to be capable of meshing with both of the cam gear 62 and the gear 70*b* of the holder 70.

The pendulum arm 67 is given friction to the central gear 66 by a mechanism, not shown, and is swingable in the direction of arrow J or the direction of arrow K by the rotative movement of the central gear 66 in conformity with the direction of rotation thereof. An arm 72 is swingably supported on the base 75 by the shaft portion 72*a* thereof. On the arm 72, a cap 71 is disposed so as to be capable of contacting wit the discharge port surface 13 of the recording head 3, and a pressing spring 74 is mounted between the spring securing portion 72*b* at the tip end of the arm 72 and the spring securing portion 75*a* of the base 75.

Also, the cam-engaging portion 72*c* of the arm 72 is urged against an arm cam 64 by the force of the pressing spring 74. A tube 73 has one end thereof connected to the pipe portion 72*d* of the arm 72, is passed over along the base 75 and is crushable by the roller 69 urged (pressed) by a spring, not shown. The other end of this tube 73 is connected to a waste ink reservoir, not shown.

Description will now specifically be made of the suction recovering operation of the recovery system described in connection with FIGS. 12 and 14. First, in FIGS. 12 and 14, as the central gear 66 is rotated in the direction of arrow L by the drive from a stepping motor, not shown, the pendulum arm 67 is rotated with the central gear 66 by the aforementioned friction mechanism, and swings in the direction of arrow K. At this time, the pendulum gear 68 receives the drive from the central gear 66 and is rotated thereby. As the central gear 66 is further rotated in the direction of arrow L, the pendulum gear 68 comes into meshing engagement with the cam gear 62 and as the result, the entire cam rotates in the direction of arrow H. At this time, the friction mechanism of the pendulum arm 67 is slipping relative to the central gear 66.

Here, the entire cam is rotated in the direction of arrow H about the cam shaft 61, and the edge 55*a* of the flag 55 from the light-passing side to the light-shielding side is detected by the sensor 54 (the position $P_1$ on the cam graph of FIG. 10), and from that moment, the entire cam is rotated by 38° (the position $P_2$ on the cam graph of FIG. 10) to thereby bring about the state of FIGS. 12 and 14. Thereafter, the direction of rotation of the stepping motor is reversed and the central gear 66 is rotated in the direction of arrow M. Thereupon, the pendulum arm 67 starts to swing in the direction of arrow J, and the pendulum gear 68 comes out of the meshing engagement with the cam gear 62, and further comes into meshing engagement with the gear portion 70*b* of the holder 70 to thereby rotate the holder 70 in the direction of arrow I. When it further rotates the holder 70 in the direction of arrow I to thereby bring about the state of FIGS. 12 and 14, the driving of the pendulum gear 68 comes not to be transmitted by the untoothed portion 70*c* of the holder 70, and the holder 70 is positioned at its position shown in FIGS. 12 and 14.

Next, the motor is again rotated reversely to rotate the central gear 66 in the direction of arrow L to thereby rotate the entire cam again in the direction of arrow H about the cam shaft 61, and the edge 55*b* of the flag 55 from light-shielding to light-passing is detected by the optical sensor 54 (the position $P_4$ on the cam graph of FIG. 10), and from that moment, the entire cam is rotated twice (the position $P_5$ on the cam graph of FIG. 10). At this time, the entire cam passes through the state of FIG. 13 (the state Q in FIG. 10). That is, the pump lever 65 is rotated in the direction of arrow N in FIG. 13 by the protuberant portion 63*a* of the lever cam 63 and as the result, the holder contacting portion 65*b* of the pump lever minutely rotates the projection 70*d* of the holder 70. As the result of this minute rotation, when next the pendulum gear 68 has come into meshing engagement as shown in FIG. 13, not the untoothed portion 70*c* of the holder 70 but the gear portion 70*b* of the holder 70 receives it and therefore, the holder 70 becomes rotatable in the direction of arrow I by the rotational force of the central gear 66.

Next a recording head 3 to be sucked is positioned at a position whereat it can contact with the cap 71, i.e., a position in the front-to-back direction of the plane of the drawing sheet of FIG. 14 (a position in the main scanning direction, i.e., a position in the direction of movement of the carriage 2). Next, the motor is again rotated to thereby rotate the entire cam by 78° about the cam shaft 61 and bring about the state of FIG. 15 (the state of $P_6$ on the cam graph of FIG. 10). Here, the cap 71 comes into close contact with the discharge port surface 13 of the recording heads 3 by the force of the pressing spring 74. Thereafter, the motor is rotated reversely to thereby rotate the central gear 66 in the direction of arrow M in FIG. 15 and rotate the holder 70 from the position of FIG. 13 to the position of FIG. 15. Here, the roller 69 rotates while crushing the tube 73 by the pressing force of a pressing spring, not shown. Thereby, negative pressure is produced in the cap 71 by way of the tube 73, and sucks the ink from the discharge ports of the recording heads 3.

When in the state of FIG. 15, the apparatus is stopped for a predetermined time, the pressure in the recording heads (recording means) 3 and the pressure in the right area of that portion of the tube 73 which is crushed by the roller 69 (the pressure in the tube) become substantially the same balanced state, and the flow of the ink stops. A predetermined amount of suction is secured by this series of operations.

Then, in the area wherein the roller 69 crushes the tube 73, the holder 70 is further rotated by a minute amount in the direction of arrow I to thereby produce minute negative pressure, and the motor is rotated reversely at the timing before the pressure becomes balanced, and simultaneously therewith, the entire cam is rotated in the direction of arrow H about the cam shaft 61 to bring about the state of FIG. 16 (the position $P_8$ in FIG. 10). By the swinging of the arm 72 in this process, the cap 71 becomes spaced apart from the recording head 3 while minute negative pressure remains applied into the cap 71 and therefore, the amount of residual ink on the cap—contacting surface (discharge port surface 13) of the recording heads 3 can be minimized.

Next, the motor is again rotated reversely to thereby rotate the holder 70 in the direction of arrow I and bring about a state in which as shown in FIG. 16, the driving of the holder 70 by the pendulum gear 68 is cut off, i.e., a state in which the pendulum gear is opposed to the untoothed portion 70*c*. In this process, the roller 69 squeezes the tube 73 from a state in which it has been minutely rotated in the direction of arrow I from FIG. 15 until it passes the R portion (rounded corner portion) 75*a* of the base 75 and therefore, almost all of the ink sucked into the cap 71 is discharged into the tube 73.

Thereafter, the motor is again rotated reversely to thereby rotate the entire cam in the direction of arrow H, and by way of the state of FIG. 16 to the state of FIG. 17 (the position $P_9$ in FIG. 10), the edge 55*a* of the flag from light-passing to light-shielding is detected by the sensor 54 (the position $P_1$ in FIG. 10), and from that moment, the entire can be rotated by 38° (the position P2 in FIG. 10) to bring about the aforedescribed state of FIGS. 12 and 14.

At this time, in the state of FIG. 17, the cap 71 again contacts with the recording heads 3, but since as previously described, almost all of the ink in the cap 71 has been discharged into the tube 73, the ink in the cap 71 can be prevented from being again transferred to the discharge port surface 13 of the recording heads 3.

Next, the carriage 2 (FIG. 1) carrying the recording heads 3 therein is moved in the front-to-back direction in the plane of the drawing sheet of FIG. 14 (the main scanning direction, i.e., the direction of movement of the carriage 2) to thereby retract the recording heads 3 from above the cap 71. When at this time, with the spacing operation of the cap 71, the entire cam is to be rotated in the direction of arrow H and position, it is rotated by a predetermined angle with the edge 55*a* of the flag 55 from light-passing to light-shielding detected and therefore, the error of the angle of rotation integrated by the repeated swinging movement of the pendulum arm 67 and the minute overrun of the entire cam during the sucking operation can all be cancelled and the phase of the entire cam can be positioned at a right position accurately and reliably.

The above embodiment has been described with respect to an example in which a plurality of recording heads 3 are sucked at a time, but when only one location is singly sucked, the cam is brought to the position $P_2$ in FIG. 10, and the same procedure is executed till the positioning of the roller 69 and the holder 70 at the untoothed portion, whereafter by the detection of the edge 55*b* of the flag 55 from light-shielding to light-passing, the cam is brought to the position $P_7$ in FIG. 10, and the positioning of the recording heads 3 in the front-to-back direction in the plane of the drawing sheet (the main scanning direction, i.e., the direction of movement of the carriage 2) is effected, and the cam is rotated by 45.5° and brought to the position $P_9$ in FIG. 10, whereby the capping operation is performed, and in the same procedure as that previously described, the holder 70 is rotated, and the application of negative pressure, the holding for a predetermined time (securement of a predetermined amount of suction) and the application of negative pressure by the minute rerotation of the holder 70 are effected.

Thereafter, the entire cam is rotated at the timing before the pressure becomes balanced, and the aforementioned temporary stoppage of the cam is omitted, and the edge 55*a* of the flag 55 from light-passing to light-shielding is detected at a stroke by the sensor 54 (the position $P_1$ in FIG. 10), and from that moment, the entire cam is rotated by 38° (the position $P_2$ in FIG. 10) to thereby bring about the state of FIGS. 12 and 14.

When as described above, the phase determination of the entire cam is to be done before the positioning of the recording heads 3 is effected, the edge to be detected is properly used so that during wiping, the edge 55*a* of the flag 55 from light-passing to light-shielding may be used and during suction, the edge 55*b* of the flag 55 from light-shielding to light-passing may be used, whereby the amount of rotation of the entire cam can be decreased and each recovery mode can be executed efficiently.

Another embodiment of the present invention will now be described with reference to the drawings.

Figure 19:
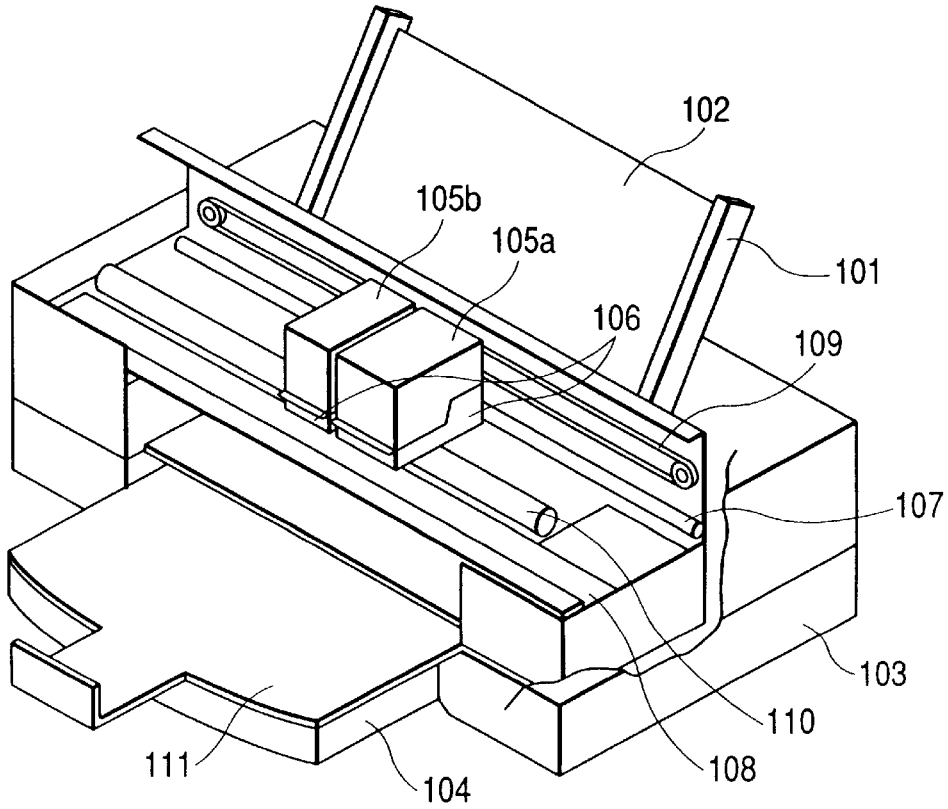
FIG. 19 is a perspective view schematically showing the construction of an ink jet recording apparatus according to another embodiment of the present invention.
Figure 20:
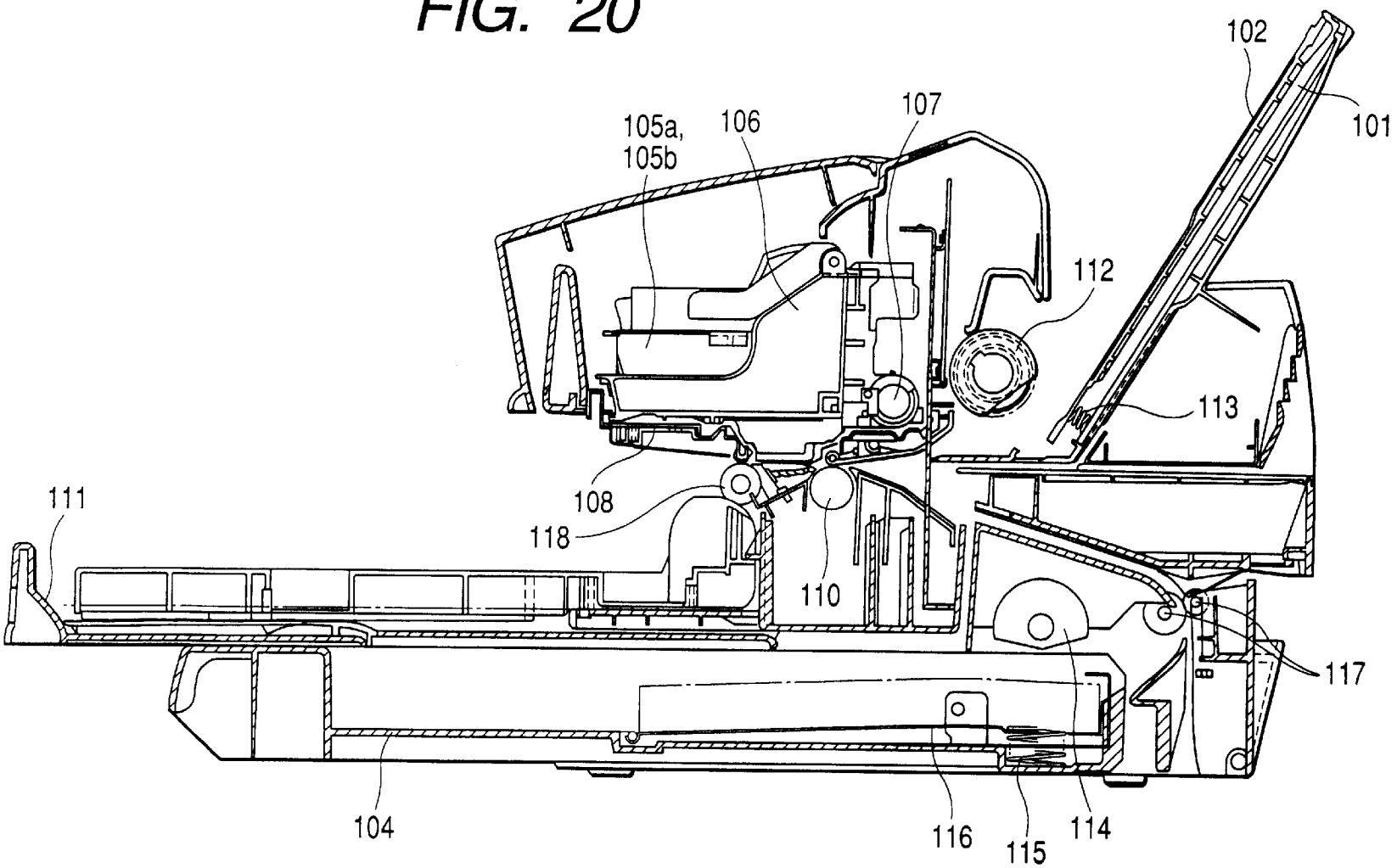
FIG. 20 is a schematic cross-sectional view of an ink jet recording apparatus according to another embodiment of the present invention.

FIG. 19 is a perspective view schematically showing the construction of an ink jet recording apparatus according to another embodiment of the present invention, and FIG. 20 is a schematic cross-sectional view of an ink jet recording apparatus according to another embodiment of the present invention.

While this embodiment will be described with respect to a case where the apparatus is provided with an ASF and a sheet cassette as a plurality of paper supply means, the present invention is not restricted thereto, but can be suitably applied to a construction provided with a plurality of various paper supply means.

In FIG. 19, the reference numeral 101 designates an ASF which is first paper supply means, and sheets S placed on a pressure plate 102 are successively separated and conveyed by the ASF 101.

The reference numeral 103 denotes a sheet cassette which is second paper supply means, and sheets S placed in a cassette 104 are successively separated and conveyed by the sheet cassette 103.

The reference characters 105*a* and 105*b* designate recording heads having ink tanks, and the reference numeral 106 denotes a carriage movable with the recording heads 105*a* and 105*b* carried thereon. Each of the recording heads 105*a* and 105*b* is provided, for example, with an electro-thermal converting member for generating heat energy for ink discharge, and discharges ink from the discharge port thereof by the utilization of film boiling created in the ink by the heat energy applied by the electro-thermal converting member.

The reference numeral 107 designates a guide shaft for supporting the carriage 106, and the reference numeral 108 denotes a main scanning rail for horizontally holding the carriage 106, which is held by the guide shaft 107 and the main scanning rail 108 and is moved.

The reference numeral 109 designates a timing belt for parallel-moving the carriage 106, and by the timing belt 109, the rotation of a motor, not shown, is converted into the parallel movement of the carriage 106.

The reference numeral 110 denotes a sub-scanning roller for conveying the sheet S conveyed by the first and second paper supply means to a printing position.

The reference numeral 111 designates a paper discharge tray for stocking thereon the sheet S discharged after the termination of printing.

Figure 21:
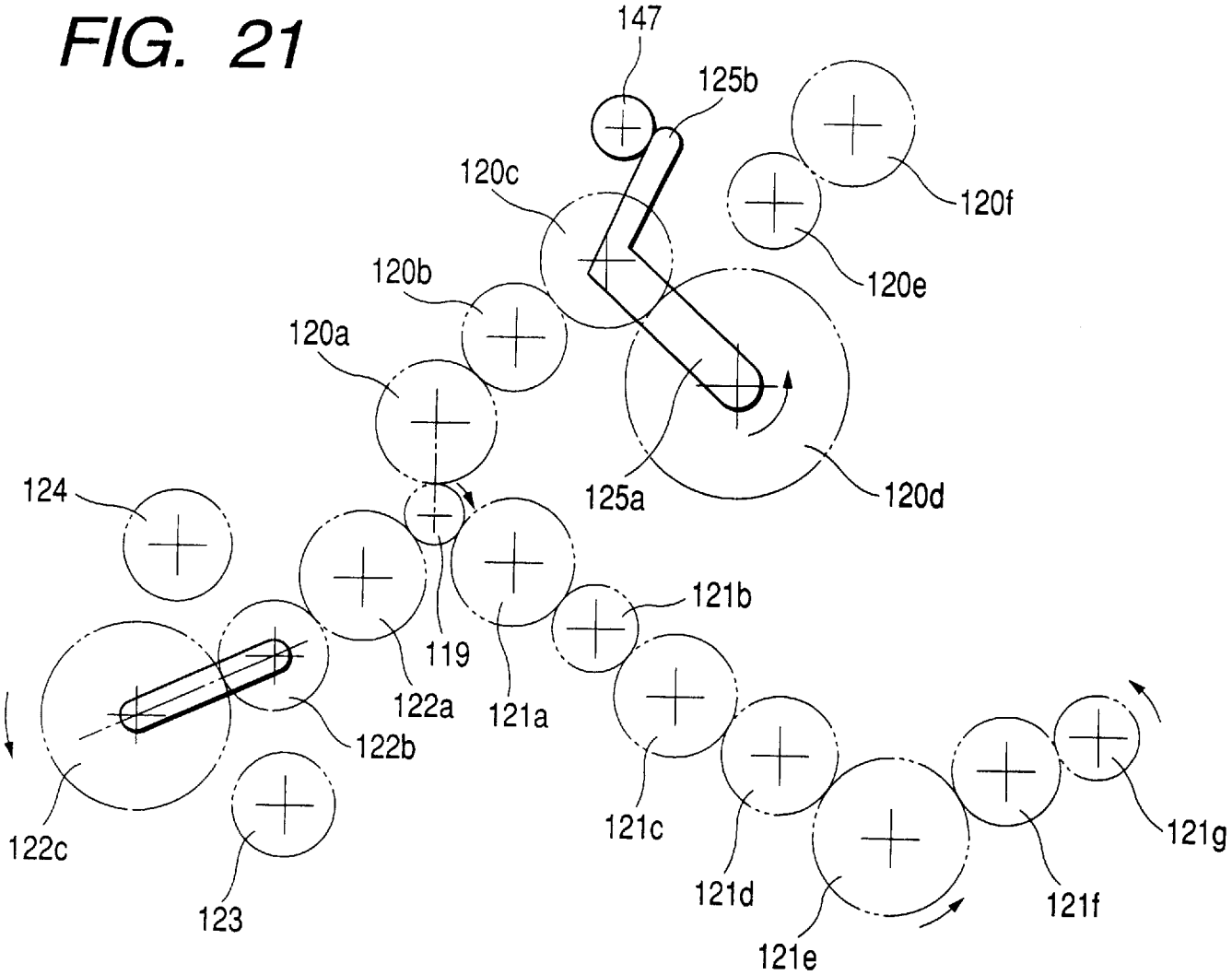
FIG. 21 shows the gear train of the driving system of an ink jet recording apparatus according to another embodiment of the present invention.

FIG. 21 is a typical view showing a driving system for the first and second paper supply means and the recovery means according to the present invention.

In FIG. 21, the reference numeral 119 denotes a gear connected to a drive source, and the reference characters 120*a*–120*f* designate a gear train to the first paper supply means, and the gears 120*c* and 120*d* are connected together by a lever 125*a*, and the gear 119 is rotated in the direction of arrow (forward direction). Thereby, the lever 125*a* tries to rotate in the direction of arrow (CCW), but a lever 125*b* is contacted with by a stopper 147 and cannot be rotated. As the result, the driving of the gear 119 is not transmitted to the gear 120*e*.

A half moon-shaped paper supply roller 112 (see FIG. 20) is connected to the gear 120*f*.

The reference characters 121*a*–121*g* designate a gear train to the second paper supply means, and the gear 121*e* is connected to a half moon-shaped paper supply roller 114 (see FIG. 20) through a spring clutch, not shown, and a conveying roller 117 (see FIG. 20) is connected to the gear 121*g*.

The reference characters 122*a*–122*c*, 123 and 124 denote a gear train to the recovery means, not shown, and the central gear 122*b* and the pendulum gear 122*c* are in the form of a pendulum mechanism, and when the gear 119 is rotated in the direction of arrow (forward direction), the pendulum gear 122*c* is rotated in the direction of arrow (CCW) and contacts with the gear 123.

When conversely, the gear 119 is rotated in a direction (CCW) opposite to the direction of arrow, the pendulum gear 122*c* is rotated in a direction (CCW) opposite to the direction of arrow, and contacts with the cam gear 124.

In the present embodiment, the details of the driving system for the recovery mechanism are the same as in the previous embodiment.

Description will now be made of the paper supply by the ASF which is the first paper supply means.

When the drive source is rotated so that the gear 119 may be rotated in the direction of arrow in FIG. 21, the drive is transmitted to the gear 120*d* as previously described. Here, when design is made such that the stopper 147 can be moved back and forth in the plane of the drawing sheet of FIG. 21 by the carriage 106, the lever 125*b* does not contact with the stopper 147 and therefore, the lever 125*a* is rotated in the direction of arrow and the gears 120*d* and 120*e* contact with each other, and the rotation of the gear 119 is transmitted to the half moon-shaped paper supply roller 112 (see FIG. 20) through the gear 120*f*.

The sequence in the meantime will now be described in greater detail with reference to FIG. 22. First, the carriage 106 is moved to a predetermined position (the step S1 of FIG. 22), and the stopper 147 is retracted (the step S2 of FIG. 22). Next, the drive source connected to the gear 119 is rotated in a forward direction (the step S3 of FIG. 22), whereupon the lever 125*a* is rotated in the direction CCW (counter-clockwisely), and the gears 120*d* and 120*e* contact with each other (the step S4 of FIG. 22) and the driving of the gear 19 is transmitted to the gear 120*f*.

Figure 22:
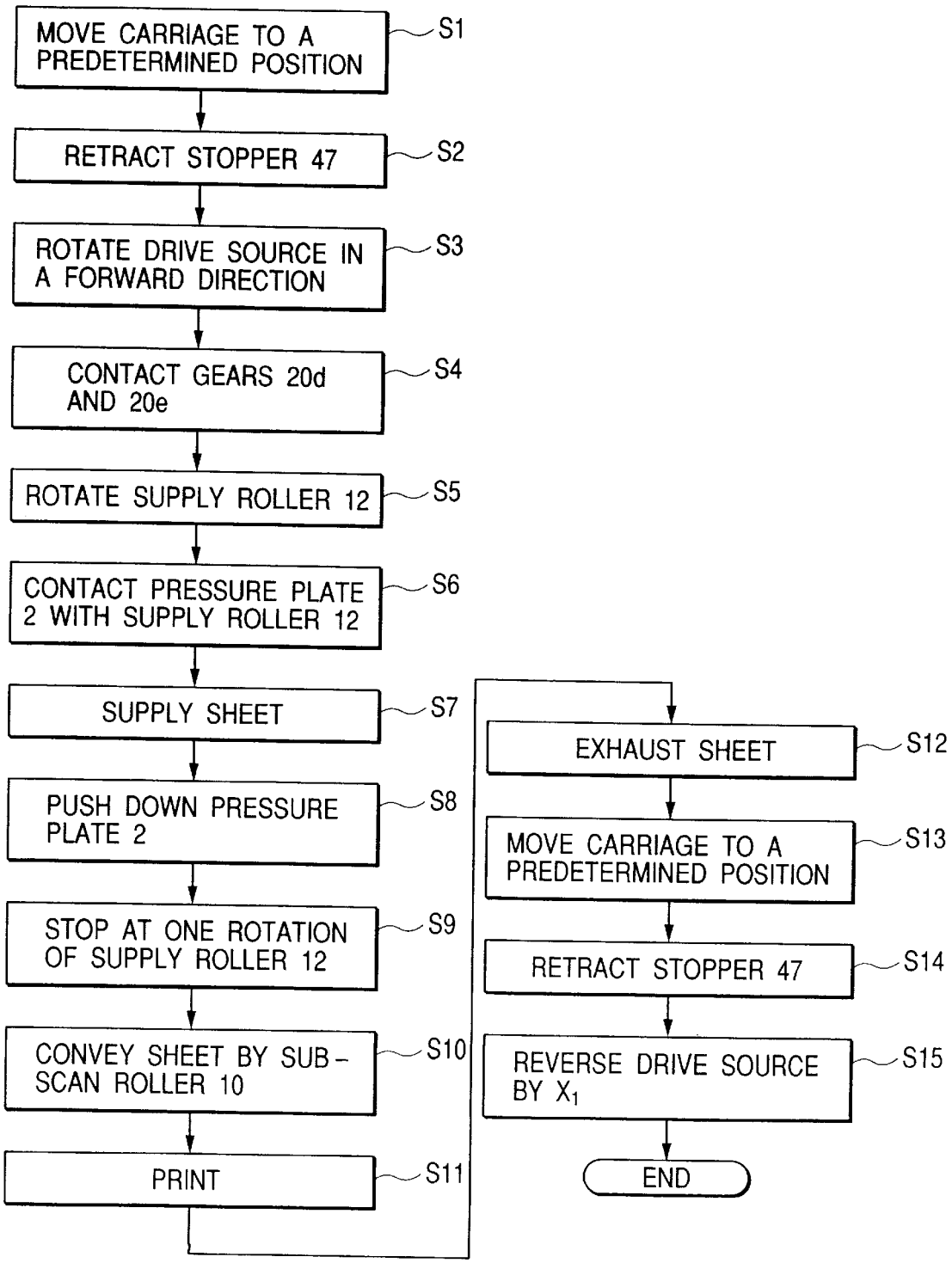
FIG. 22 shows the sequence of first paper supply means of an ink jet recording apparatus according to another embodiment of the present invention.

The half moon-shaped paper supply roller 112 (see FIG. 20) is connected to the gear 120*f*, and the paper supply roller 112 begins to be rotated (the step S5 of FIG. 22). Although not shown, there is a cam on the periphery of the paper supply roller 112, and in the waiting state, this cam pushes down the pressure plate 102 (see FIG. 20) and therefore, paper is easy to set on the ASF 101. With the rotation of the paper supply roller 112, the cam is rotated to bring the pressure plate 102 into a free state. Thereupon, the pressure plate 102 is pushed up by the spring 113 (see FIG. 20) and is urged against the paper supply roller 112 (the step S6 of FIG. 22). If at this time, the sheets S are set on the pressure plate 102, the sheets S on the pressure plate 102 are separated and conveyed one by one by the conveying force resulting from the rotation of the paper supply roller 112 and the work of a separating pawl (the step S7 of FIG. 22).

Thereafter, the paper supply roller 112 is rotated, and the cam on the paper supply roller 112 again pushes down the pressure plate 102 (the step S8 of FIG. 22) and the paper supply roller 112 is stopped at one rotation (the step S9 of FIG. 22) so that the next sheet S may not be fed. Also, during the time when the drive source connected to the gear 119 is being rotated in the forward direction, the pendulum gear 122*c* contacts with the untoothed portion 123*c* of the gear 123, which is thus not rotated. One rotation of the paper supply roller 112 is detected by the use of a sensor or the like.

The sheets S conveyed by the paper supply roller 112 are conveyed by the sub-scanning roller 110 (see FIG. 20) still after one rotation of the paper supply roller 112 (the step S9 of FIG. 22), are printed at the printing position (the step S10 of FIG. 22), are exhausted by the paper discharging roller 118 (see FIG. 20) (the steps S11 of FIG. 22) and are piled on the paper discharge tray 111 (see FIG. 20).

Each time one cycle of paper supply by the operation of the ASF is terminated, the carriage 106 is moved (the step S12 of FIG. 22) and the stopper 147 is moved so that the lever 125*b* can move freely (the step S13 of FIG. 22). Thereafter, the drive source connected to the gear 119 is rotated in a reverse direction by a predetermined amount $X_1$ (the step S14 of FIG. 22), whereupon the driving of the gears 120*d* and 120*e* is cut off. When in this state, the carriage 106 is again moved and the stopper 147 is returned to its original position, the paper supply roller 112 of the ASF cannot rotate even if the drive source is rotated in the forward direction.

The amount of reverse rotation $X_1$ is an amount smaller than in FIG. 21, the pendulum gear 122*c* contacts with the gear 123 to the cam gear 124. By adopting such a construction, it becomes possible to effect the paper supply from the ASF without affecting the operation of the recovery system.

Also, conversely, it never happens that the ASF operates erroneously even during the operation of the recovery system.

Description will now be made of the paper supply by the sheet cassette which is the second paper supply means.

Figure 23:
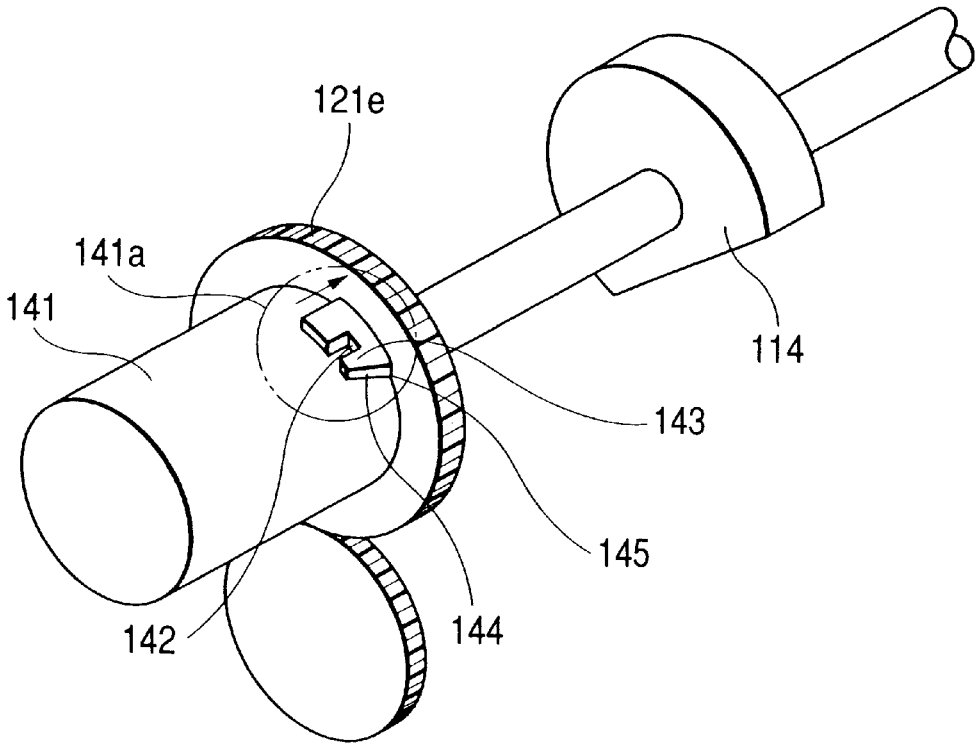
FIG. 23 show a mechanism around the spring clutch of second paper supply means of the ink jet recording apparatus according to another embodiment of the present invention.
Figure 24A:
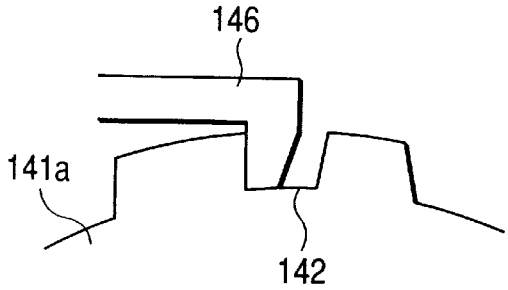
FIGS. 24A, 24B and 24C are views for illustrating the action by the cam of the spring clutch of the second paper supply means of the ink jet recording apparatus according to another embodiment of the present invention.

When the drive source is rotated so that the gear 119 may rotate in the direction of arrow in FIG. 21, the gears 121*e* and 121*g* are rotated in the directions of arrows in FIG. 21. As shown in FIG. 23, the half moon-shaped paper supply roller 114 is connected to the gear 121*e* through the spring clutch 141. Usually, the spring clutch 141 works so that the rotation of the gear 121*e* may not be transmitted to the paper supply roller 114. There is a cam 141a on the cylindrical surface of the spring clutch 141, and an actuator 146 is in the groove portion 142 of this cam 141*a* (see FIG. 24A) so that the rotation of the gear 121*e* may not be transmitted to the paper supply roller 114.

Figure 24B:
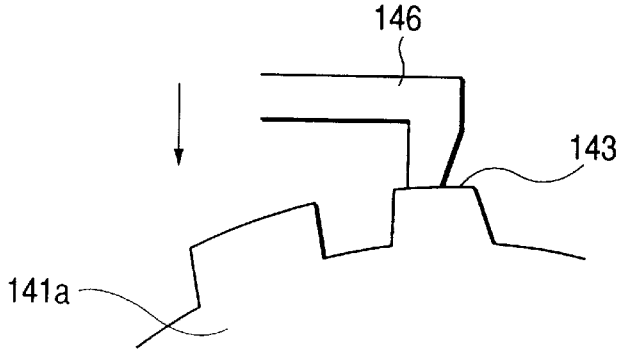
Figure 25:
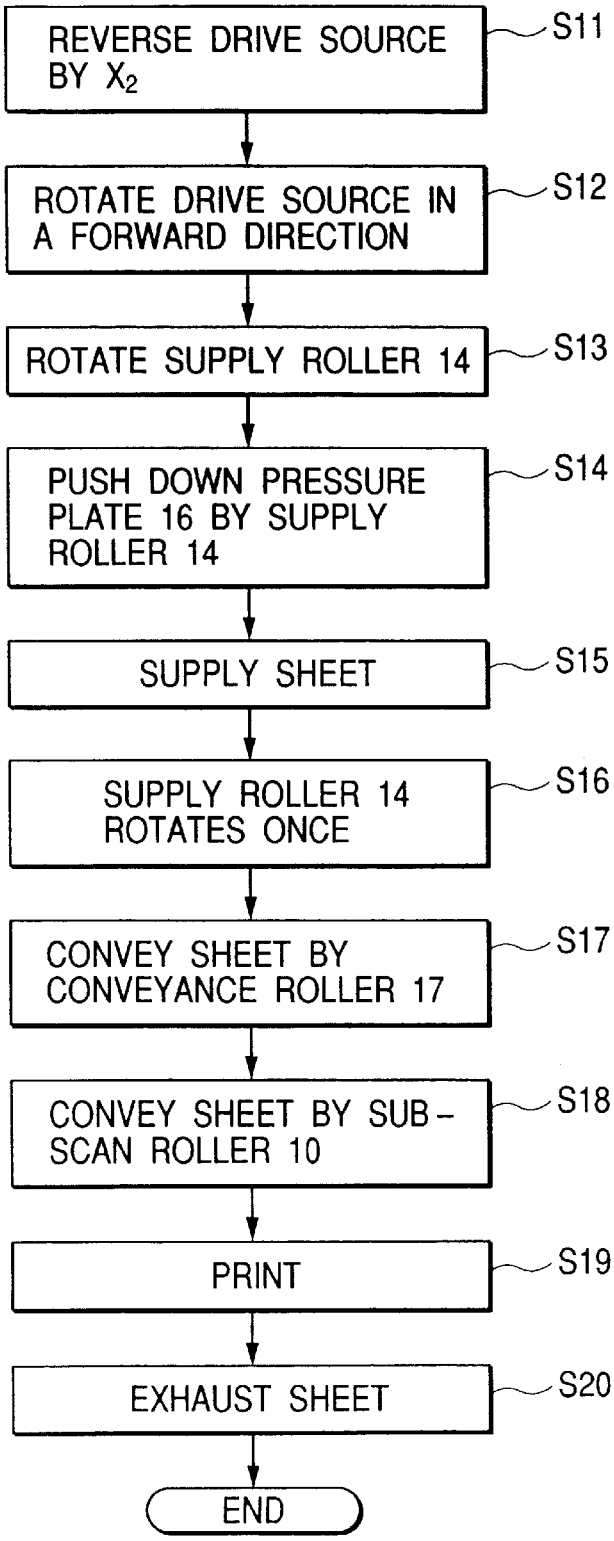
FIG. 25 shows the sequence of the second paper supply means of the ink jet recording apparatus according to another embodiment of the present invention.
Figure 26:
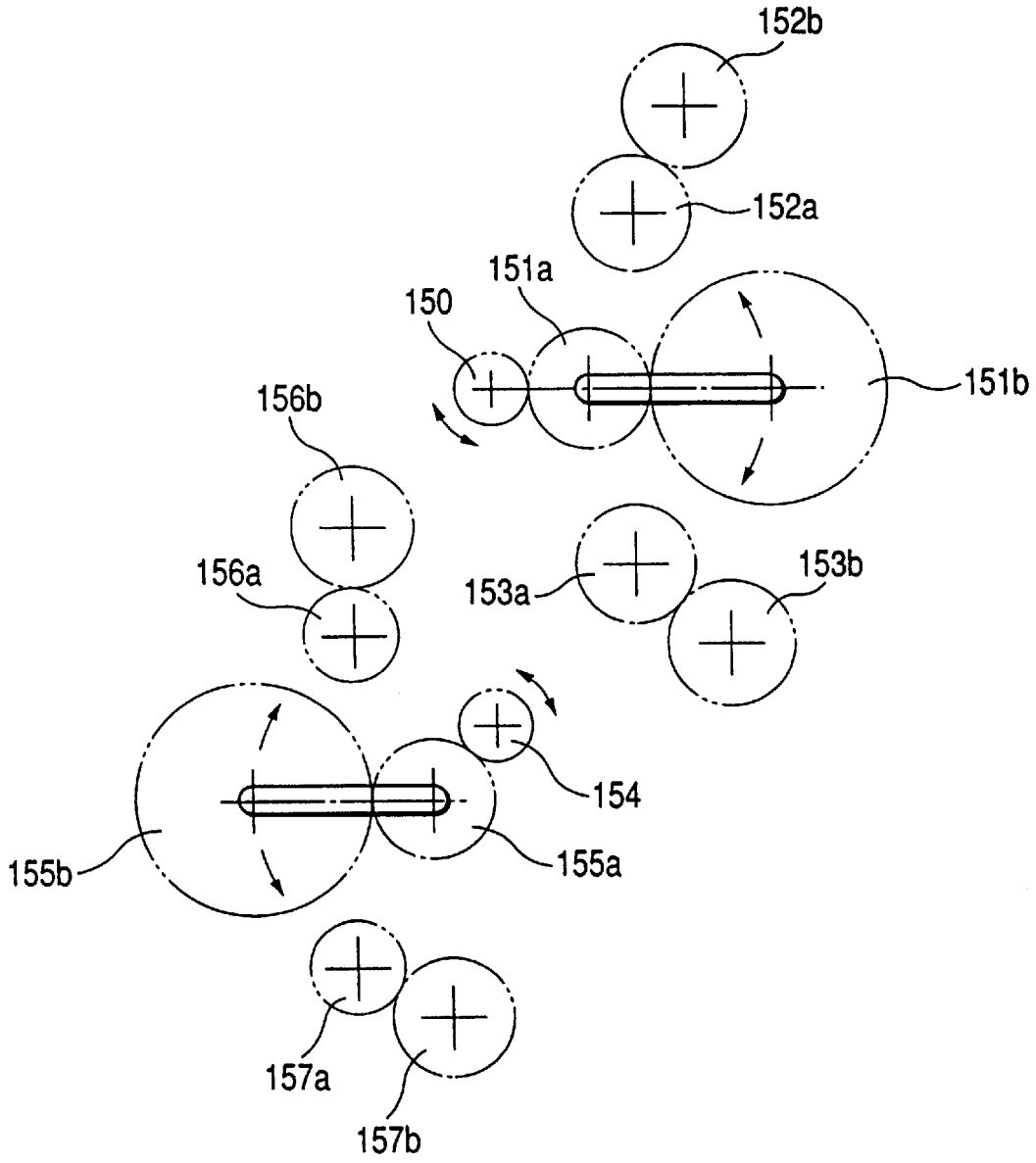
FIG. 26 PRIOR ART
FIG. 26 shows an example of the gear train of a driving system for first and second paper supply means and recovery means of an ink jet recording apparatus according to the prior art.

However, when the drive source is rotated oppositely (rotated reversely) to the direction of arrow in FIG. 21 by an amount of rotation $X_2$ (the step S11 of FIG. 25), the gear 121*e* is rotated in a direction opposite to the direction of arrow in FIG. 21. At this time, the spring clutch 141 is rotated in the same direction as the gear 121*e*, and the paper supply roller 114 is also rotated in the same direction. Thereupon, the actuator 146 rides onto the cylindrical cam surface 143 of the spring clutch 141 (see FIG. 24B). Forces in the direction of arrow in FIG. 23 and in the direction of arrow in FIG. 24B are applied to the actuator 146 and therefore, when the actuator 146 rides onto the cam surface 143, it moves to the end surface of the gear 121*e*. When in this state, the drive source is rotated in the direction of arrow in FIG. 21 (the step S12 of FIG. 25), the gear 121*e* is rotated in the direction of arrow in FIG. 21 and the spring clutch 141 and the paper supply roller 114 are also rotated in the same direction as the gear 121*e*. At this time, the actuator 146 is on the end surface of the gear 121*e* and therefore does not go into the groove 142 in the cam surface of the spring clutch 141 but passes it. Thereupon, the paper supply roller 114 is rotated (the step S13 of FIG. 25), and pushes down the pressure plate 116 pushed up by the spring 115 in the cassette 104 (the steps S14 of FIG. 25), and produces a conveying force and separates and conveys the sheet S set on the pressure plate 116, by the work of a separating pawl, not shown (the step S15 of FIG. 25).

When the paper supply roller 114 effects one rotation (the step S14 of FIG. 25), the actuator 146 passes the cam surface 144 of the spring clutch 141 and goes into the groove portion 142. Thereupon, the rotation of the gear 121*e* is not transmitted to the paper supply roller 114. After one rotation of the paper supply roller 114, the sheet S is conveyed by the conveying roller 117 connected to the gear 121*g* (the step S17 of FIG. 25), is conveyed to the printing position by the sub-scanning roller 110 (the step S18 of FIG. 25), and after printing (the step S19 of FIG. 25), the sheet is exhausted (the step S20 of FIG. 25).

Also, it is the same as in the case of the ASF that the recovery system is not operated during the time when the drive source is rotated in the forward direction.

Figure 24C:
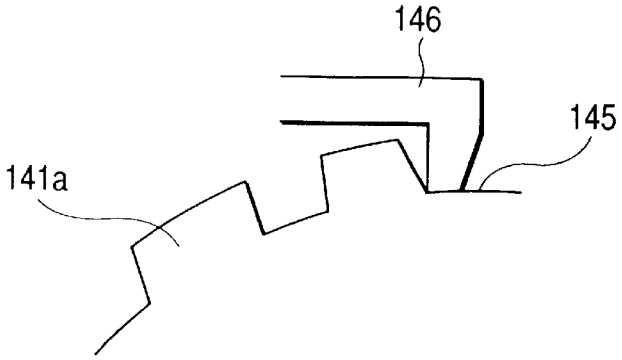

Further, when the amount of reverse rotation of the drive source is great, the actuator 146 further advances from the cam surface 143 of the paper supply clutch 141 and is positioned on the cam surface 145 (see FIG. 24C). When from this state, the drive source is rotated in the forward direction, the actuator 146 passes the cam surface 144 and goes into the groove portion 142, and the rotation of the gear 121*e* is not transmitted to the paper supply roller 114.

So, if the amount of reverse rotation $X_1$ of the ASF is set so as to bring about the state of FIG. 24C, the sheet cassette will not be affected even if ASF paper supply is effected. That is, if the amount of reverse rotation $X_2$ of the sheet cassette is made smaller than the amount of reverse rotation $X_1$ of the ASF and the state of FIG. 24C is brought about by the amount of amount of reverse rotation $X_1$, the paper supply by the ASF and the paper supply by the sheet cassette will not interfere with each other. Further, the sheet cassette will not operate erroneously even during the operation of the recovery system.

By the above-described construction, the driving of the recovery system necessary for forward rotation and reverse rotation and the driving of the plurality of paper supply means can be made into one and thus, a reduction in cost can be achieved.

While the above embodiments have been described with respect to an ink jet recording apparatus of the serial recording type which effects recording while recording means is moved relative to a recording medium, the present invention can likewise be applied to an ink jet recording apparatus of the line recording type which effects recording by only sub-scanning by the use of recording means of the line type covering the full width or a part of a recording medium, and can achieve a similar effect.

The present invention can also be applied to a recording apparatus using a simple recording means, a color recording apparatus using a plurality of recording means for recording with inks of different colors, or a harmony recording apparatus using a plurality of recording means for recording in the same color and at different densities, or further a recording apparatus comprising a combination of these, and can achieve a similar effect. Further, the present invention can also be applied to any arrangement and construction of a recording head and an ink tank, such as a construction using an interchangeable ink cartridge comprising a recording head and an ink tank made into a unit, or a construction in which a recording head and an ink tank are made discrete from each other and are connected together by a tube for ink supply or the like, and can achieve a similar effect.

The present invention can also be applied to ink jet recording apparatuses using recording means using electromechanical converting members such as piezoelectric elements, and above all, brings about an excellent effect in an ink jet recording apparatus using recording means of the type which discharges ink by the utilization of heat energy, because according to such a type, the higher density and higher fineness of recording can be achieved.

What is claimed is:

1. An ink jet recording apparatus comprising:

a movable carriage for mounting a recording head having a discharge port for discharging ink;

a wiper for wiping a surface on which said discharge port of said recording head is provided;

suction means for sucking from said discharge port of said recording head;

first sheet feeding means for conveying a recording medium to be recorded by said recording head;

second sheet feeding means for conveying a recording medium to be recorded by said recording head;

a common drive source for generating a drive force for performing a wiping operation of said wiper, a suction operation by said suction means, a first sheet feeding operation by said first sheet feeding means and a second sheet feeding operation by said second sheet feeding means;

a first gear train connected to a gear of said common drive source to transmit the drive force of said common drive source to said first sheet feeding means;

a second gear train connected to a gear of said common drive source to transmit the drive force of said common drive source to said second sheet feeding means; and a third gear train connected to a gear of said common drive source to transmit the drive force of said common drive source to said wiper and said suction means, wherein a position of said carriage, a rotation direction of said drive source and a rotation amount of said drive source are controlled so that the wiping operation of said wiper, the suction operation by said suction means, the first sheet feeding operation by said first sheet feeding means and the second sheet feeding operation by said second sheet feeding means are selectively performed.

2. An ink jet recording apparatus according to claim 1, characterized in that by controlling the position of a carriage movable with said recording head carried thereon, the direction of rotation of said drive source, and the amount of rotation of said drive source in each of forward and reverse directions, the wiping operation of said wiper and the suction operation of said suction means are selectively effected and one of said plurality of sheet feeding means is selected and driven.

3. An ink jet recording apparatus according to claim 2, characterized in that said first gear train has a pendulum gear and a stopper for regulating the range of swinging of said pendulum gear movable in conformity with the position of said carriage, and effects the driving and stoppage of said first sheet feeding means depending on the position of said carriage, the direction of rotation of said drive source and the amount of rotation of said drive source in each of forward and reverse directions, said second gear train has a spring clutch, and effects the driving and stoppage of said second sheet feeding means depending on the direction of rotation of said drive source and the amount of rotation of said drive source in each of forward and reverse directions, and said third gear train has a pendulum gear, and selectively effects the wiping operation of said wiper and the suction operation of said suction means depending on the position of said carriage, the direction of rotation of said drive source and the amount of rotation of said drive source in each of forward and reverse directions.

4. An ink jet recording apparatus according to claim 3, characterized in that said first sheet feeding means is an auto sheet feeder, and said second sheet feeding means is a sheet cassette.

5. An ink jet recording apparatus according to claim 1, characterized in that said recording head is provided with an electro-thermal converting member for generating heat energy for ink discharge.

6. An ink jet recording apparatus according to claim 5, characterized in that said recording head discharges ink from the discharge port by the utilization of film boiling caused in the ink by the heat energy applied by said electro-thermal converting member.

7. An ink jet recording apparatus according to claim 1 characterized in that said suction means is a tube pump.

8. An ink jet recording apparatus according to claim 1, wherein positioning for the wiping operation by said wiper is performed by a first edge of a cam flag and positioning for the suction operation by said suction means is performed by a second edge of said cam flag.

* * * * *

UNITED STATES PATENT AND TRADEMARK OFFICE

CERTIFICATE OF CORRECTION

PATENT NO. : 6,312,093 B1
DATED : November 6, 2001
INVENTOR(S) : Yasutsugu Saijo et al.

It is certified that error appears in the above-identified patent and that said Letters Patent is hereby corrected as shown below:

Title page,
Item [57], ABSTRACT,
Line 4, "wiping" should read -- wiper --.

Column 2,
Line 36, ""problem" should read -- problems --.

Column 9,
Line 65, "the" (first occurrence) should be deleted.

Signed and Sealed this

Sixth Day of August, 2002

*Attest:*

*Attesting Officer*

JAMES E. ROGAN
*Director of the United States Patent and Trademark Office*